US008523700B2

(12) United States Patent
Sander

(10) Patent No.: US 8,523,700 B2
(45) **Date of Patent: *Sep. 3, 2013**

(54) RELEASABLE AND INTERCHANGEABLE CONNECTIONS FOR GOLF CLUB HEADS AND SHAFTS

(75) Inventor: Raymond J. Sander, Benbrook, TX (US)

(73) Assignee: Nike, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/325,537

(22) Filed: Dec. 14, 2011

(65) Prior Publication Data

US 2012/0083355 A1 Apr. 5, 2012

Related U.S. Application Data

(63) Continuation of application No. 12/509,231, filed on Jul. 24, 2009, now Pat. No. 8,096,894.

(51) Int. Cl.
*A63B 53/02* (2006.01)

(52) U.S. Cl.
USPC ..... 473/288; 473/307; 473/309

(58) Field of Classification Search
USPC ..... 473/288, 307, 296, 298, 299, 294, 473/244–248; 403/359.1, 359.5
See application file for complete search history.

(56) References Cited

U.S. PATENT DOCUMENTS

| | | | |
|---|---|---|---|
| 591,741 | A | 10/1897 | Deem |
| 1,019,657 | A | 3/1912 | Kerr |
| 1,266,529 | A | 5/1918 | Mattern |
| 1,792,852 | A | 12/1926 | Mattern |
| 1,623,523 | A | 4/1927 | Bourke |
| 1,634,082 | A | 6/1927 | Rigby |
| 1,850,843 | A | 3/1932 | Lagerblade |
| 2,067,556 | A | 1/1937 | Wettlaufer |
| 2,219,670 | A | 10/1940 | Wettlaufer |
| 2,451,262 | A | 10/1948 | Watkins |
| 2,464,850 | A | 3/1949 | Crawshaw |

(Continued)

FOREIGN PATENT DOCUMENTS

| | | |
|---|---|---|
| EP | 0300119 | 12/1992 |
| GB | 392493 | 5/1933 |

(Continued)

OTHER PUBLICATIONS

International Search Report in related International Application No. PCT/US2011/059727; mailed Jan. 30, 2012.

(Continued)

*Primary Examiner* — Stephen L. Blau
(74) *Attorney, Agent, or Firm* — Banner & Witcoff, Ltd.

(57) ABSTRACT

Assemblies for releasably connecting a golf club head and shaft may include: (a) a shaft engaging member including a rotation-inhibiting structure having a circular cross-section and a first set of circumferentially spaced teeth; (b) a club head engaging member including a retaining structure for engaging the rotation-inhibiting structure, the retaining structure having a circular opening with a second set of circumferentially spaced teeth to engage the first set of teeth on the rotation-inhibiting structure; and (c) a securing system for releasably securing the shaft engaging member with respect to the club head engaging member. The first set of teeth may have a different number of teeth than the second set of teeth. Golf club heads are releasably engaged with shafts so that the shafts can be readily interchanged and/or so that the shaft position with respect to the club head can be readily changed.

15 Claims, 16 Drawing Sheets

(56) References Cited

U.S. PATENT DOCUMENTS

| | | | |
|---|---|---|---|
| 3,206,206 | A | 9/1965 | Santosuosso |
| 3,516,697 | A | 6/1970 | Hahn |
| 3,524,646 | A | 8/1970 | Wheeler |
| 3,596,938 | A | 8/1971 | Tizzard |
| 3,656,366 | A | 4/1972 | Somero |
| 3,848,737 | A | 11/1974 | Kenon |
| 3,891,212 | A | 6/1975 | Hill |
| RE29,376 | E | 8/1977 | Hiszpanski |
| 4,253,666 | A | 3/1981 | Murphy |
| 4,340,227 | A | 7/1982 | Dopkowski |
| 4,664,382 | A | 5/1987 | Palmer et al. |
| 4,854,582 | A | 8/1989 | Yamada |
| 4,948,132 | A | 8/1990 | Wharton |
| 4,958,834 | A | 9/1990 | Colbert |
| 4,984,794 | A | 1/1991 | Pernelle et al. |
| 5,165,688 | A | 11/1992 | Schmidt |
| 5,232,224 | A | 8/1993 | Zeider |
| 5,275,399 | A | 1/1994 | Schmidt |
| 5,275,408 | A | 1/1994 | Desbiolles et al. |
| 5,429,355 | A | 7/1995 | Schmidt |
| 5,433,442 | A | 7/1995 | Walker |
| 5,577,726 | A | 11/1996 | Fenton |
| 5,588,921 | A | 12/1996 | Parsick |
| 5,626,528 | A | 5/1997 | Toulon |
| 5,792,002 | A | 8/1998 | Bothwell |
| 5,839,973 | A | 11/1998 | Jackson |
| 5,851,155 | A | 12/1998 | Wood et al. |
| 5,855,526 | A | 1/1999 | Honma |
| 5,906,549 | A | 5/1999 | Kubica |
| 5,951,411 | A | 9/1999 | Wood et al. |
| 6,095,929 | A | 8/2000 | Clark |
| 6,149,533 | A | 11/2000 | Finn |
| 6,203,443 | B1 | 3/2001 | Britton |
| 6,251,028 | B1 | 6/2001 | Jackson |
| 6,270,425 | B1 | 8/2001 | Dyer |
| 6,273,828 | B1 | 8/2001 | Wood et al. |
| 6,287,215 | B1 | 9/2001 | Fisher |
| 6,319,146 | B1 | 11/2001 | Mills |
| 6,332,945 | B1 | 12/2001 | Lenhof |
| 6,368,230 | B1 | 4/2002 | Helmstetter et al. |
| 6,447,404 | B1 | 9/2002 | Wilbur |
| 6,475,100 | B1 | 11/2002 | Helmstetter et al. |
| 6,508,288 | B2 | 1/2003 | Lenhof |
| 6,547,673 | B2 | 4/2003 | Roark |
| 6,652,388 | B1 | 11/2003 | Lenhof |
| 6,669,573 | B2 | 12/2003 | Wood et al. |
| 6,797,106 | B2 | 9/2004 | Lenhof |
| 6,863,622 | B1 | 3/2005 | Hsu |
| 6,890,269 | B2 | 5/2005 | Burrows |
| 7,017,252 | B2 | 3/2006 | Lenhof |
| 7,056,225 | B1 | 6/2006 | Pipkin |
| 7,083,529 | B2 | 8/2006 | Cackett |
| 7,115,046 | B1 | 10/2006 | Evans |
| 7,144,330 | B2 | 12/2006 | Wade |
| 7,300,359 | B2 | 11/2007 | Hocknell |
| 7,316,622 | B1 | 1/2008 | Lucas |
| 7,326,126 | B2 | 2/2008 | Holt |
| 7,335,113 | B2 | 2/2008 | Hocknell |
| 7,344,449 | B2 | 3/2008 | Hocknell et al. |
| 7,476,160 | B2 | 1/2009 | Hocknell et al. |
| 7,699,717 | B2 | 4/2010 | Morris et al. |
| 7,704,156 | B2 | 4/2010 | Stites et al. |
| 7,704,158 | B2 | 4/2010 | Burrows |
| 7,722,474 | B2 | 5/2010 | Thomas et al. |
| 7,722,475 | B2 | 5/2010 | Thomas et al. |
| 7,789,766 | B2 | 9/2010 | Morris et al. |
| 7,789,769 | B2 | 9/2010 | Sugimoto |
| 7,887,431 | B2 | 2/2011 | Beach et al. |
| 7,931,542 | B2 | 4/2011 | Kusumoto |
| 7,955,182 | B2 | 6/2011 | Thomas et al. |
| 7,955,184 | B2 | 6/2011 | Stites et al. |
| 7,955,185 | B2 | 6/2011 | Tavares et al. |
| 7,963,856 | B2 | 6/2011 | Yamamoto |
| 7,980,959 | B2 | 7/2011 | Morris et al. |
| 8,002,644 | B2 | 8/2011 | Hocknell et al. |
| 2002/0037773 | A1 | 3/2002 | Wood et al. |
| 2003/0050130 | A1 | 3/2003 | Wade |
| 2004/0018886 | A1 | 1/2004 | Burrows |
| 2004/0018887 | A1 | 1/2004 | Burrows |
| 2004/0023728 | A1 | 2/2004 | Drossos |
| 2005/0049072 | A1 | 3/2005 | Burrows |
| 2006/0105855 | A1 | 5/2006 | Cackett et al. |
| 2006/0183564 | A1 | 8/2006 | Park |
| 2006/0281575 | A1 | 12/2006 | Hocknell et al. |
| 2006/0293116 | A1 | 12/2006 | Hocknell et al. |
| 2007/0004528 | A1 | 1/2007 | Hocknell et al. |
| 2007/0078026 | A1 | 4/2007 | Holt et al. |
| 2007/0117645 | A1 | 5/2007 | Nakashima |
| 2007/0173344 | A1 | 7/2007 | Burch |
| 2007/0265106 | A1 | 11/2007 | Burrows |
| 2008/0051211 | A1 | 2/2008 | Hocknell |
| 2008/0058114 | A1 | 3/2008 | Hocknell |
| 2008/0070717 | A1 | 3/2008 | Hocknell et al. |
| 2008/0268977 | A1 | 10/2008 | Cole et al. |
| 2008/0280693 | A1 | 11/2008 | Chai |
| 2009/0011848 | A1 | 1/2009 | Thomas et al. |
| 2009/0011849 | A1 | 1/2009 | Thomas et al. |
| 2009/0011850 | A1 | 1/2009 | Stites et al. |
| 2009/0062029 | A1 | 3/2009 | Stites et al. |
| 2009/0075748 | A1 | 3/2009 | Evans et al. |
| 2009/0156323 | A1 | 6/2009 | Yamamoto |
| 2009/0181791 | A1 | 7/2009 | Sanchez et al. |
| 2009/0197694 | A1 | 8/2009 | Soracco et al. |
| 2009/0239676 | A1 | 9/2009 | Bennett et al. |
| 2009/0286618 | A1 | 11/2009 | Beach et al. |
| 2009/0286619 | A1 | 11/2009 | Beach et al. |
| 2010/0035701 | A1 | 2/2010 | Kusumoto |
| 2010/0041491 | A1 | 2/2010 | Thomas et al. |
| 2010/0197422 | A1 | 8/2010 | Thomas et al. |
| 2010/0197423 | A1 | 8/2010 | Thomas et al. |

FOREIGN PATENT DOCUMENTS

| | | |
|---|---|---|
| GB | 443439 | 2/1936 |
| GB | 751323 | 6/1956 |
| GB | 2331464 | 5/1999 |
| JP | 2000024143 | 1/2000 |
| JP | 2000093569 | 4/2000 |
| JP | 2004534599 | 11/2004 |
| JP | 2005270402 | 10/2005 |
| JP | 2005533626 | 11/2005 |
| JP | 2006042950 | 2/2006 |
| JP | 2006042951 | 4/2006 |
| NZ | 575598 | 3/2009 |
| WO | 9000424 | 1/1990 |
| WO | 9609856 | 4/1996 |
| WO | 2004009186 | 1/2004 |
| WO | 2007022671 | 3/2007 |
| WO | 2009009262 | 1/2009 |
| WO | 2009035345 | 3/2009 |

OTHER PUBLICATIONS

Chinese Office Action in related Chinese Application No. 200980132894.7; issued Jan. 4, 2012.

International Search Report in related International PCT Application No. PCT/US2010/042434; mailed Dec. 20, 2010.

International Search Report in related International PCT Application No. PCT/US2010/022699; mailed Apr. 26, 2010.

Canadian Office Action in related Canadian Application No. 2692345; dated Aug. 5, 2011.

Japanese Office Action in related Japanese Application No. 2010-514982; dated Feb. 22, 2012.

Chinese Office Action in related Chinese Application No. 200880101899.9; issued Aug. 3, 2011.

Australian Office Action in related Australian Application No. 2008275470; dated Oct. 14, 2010.

International Search Report in related International Application No. PCT/US08/67348; dated Nov. 7, 2008.

Canadian Office Action in related Canadian Application No. 2692356; dated Aug. 12, 2011.

Korean Office Action in related Korean Application No. 1020107001608; delivered Oct. 11, 2011.

Chinese Office Action in related to Chinese Application No. 200880102102.7; dated Apr. 8, 2011.
Chinese Office Action in related Chinese Application No. 200880102102.7; issued Feb. 28, 2012.
Australian Office Action in related Australian Application No. 2008275411; dated Feb. 9, 2011.
International Search Report in related International PCT Application No. PCT/US08/68083; dated Nov. 7, 2008.
International Search Report in related International PCT Application No. PCT/US08/73703; dated Jan. 21, 2009.
International Preliminary Report in related PCT Application No. PCT/US08/73703; dated Mar. 11, 2010.
Canadian Office Action in related Canadian Application No. 2696921; dated Aug. 9, 2011.
Korean Office Action in related Korean Application No. 10-2010-7005698; dated Dec. 5, 2011.
Australian Office Action in related Australian Application No. 2008296600; dated Dec. 10, 2010.
Australian Office Action in related Australian Application No. 2008296600; dated Jan. 20, 2012.
Canadian Office Action in related Canadian Application No. 2692267; dated Aug. 11, 2011.
Chinese Office Action in related Chinese Application No. 200880100721.2; mailed Oct. 28, 2010.
Australian Office Action in related Australian Application No. 2008275414; dated Oct. 14, 2010.
International Search Report in related International PCT Application No. PCT/US08/68116; dated Nov. 11, 2008.
International Preliminary Report in related International PCT Application No. PCT/US08/68116; dated Jan. 21, 2010.
International Search Report in related International PCT Application No. PCT/US10/25880; dated Dec. 6, 2010.
Australian Office Action in related Australian Application No. 2009274322; dated Jan. 18, 2012.
International Search Report in related International PCT Application No. PCT/US09/50344; dated Dec. 22, 2009.
International Preliminary Report in related International PCT Application No. PCT/US09/50344; dated Feb. 3, 2011.
International Search Report in related International Application No. PCT/US10/38585; dated Aug. 30, 2010.
PUKU, Technology Update Article, Mar. 23, 2009, pp. 1-5.
European Search Report in related European Patent Application No. 03748963.0; dated Apr. 7, 2008.
Japanese Office Action in related Japanese Application No. 2010-515058; dispatched Mar. 8, 2012.
Japanese Office Action in related Japanese Application No. 2010-515046; dispatched Mar. 8, 2012.
International Search Report in related International Application No. PCT/NZ2008/000233; mailed Jan. 14, 2009.

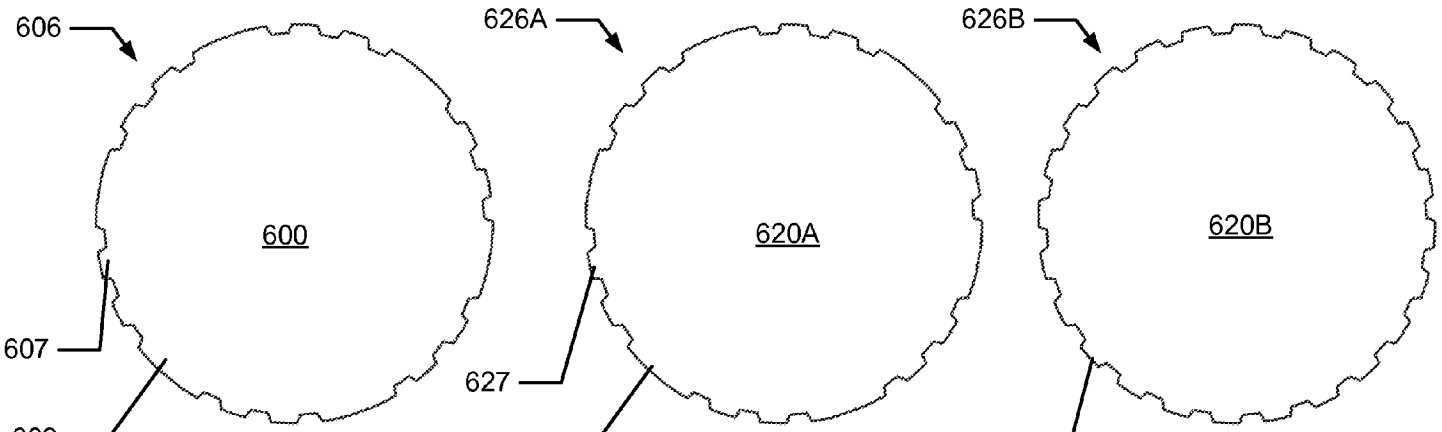
Fig. 6C
Fig. 6B
Fig. 6A
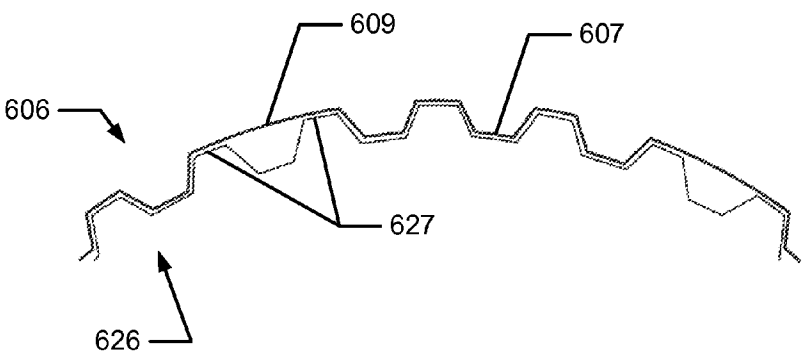
Fig. 6D

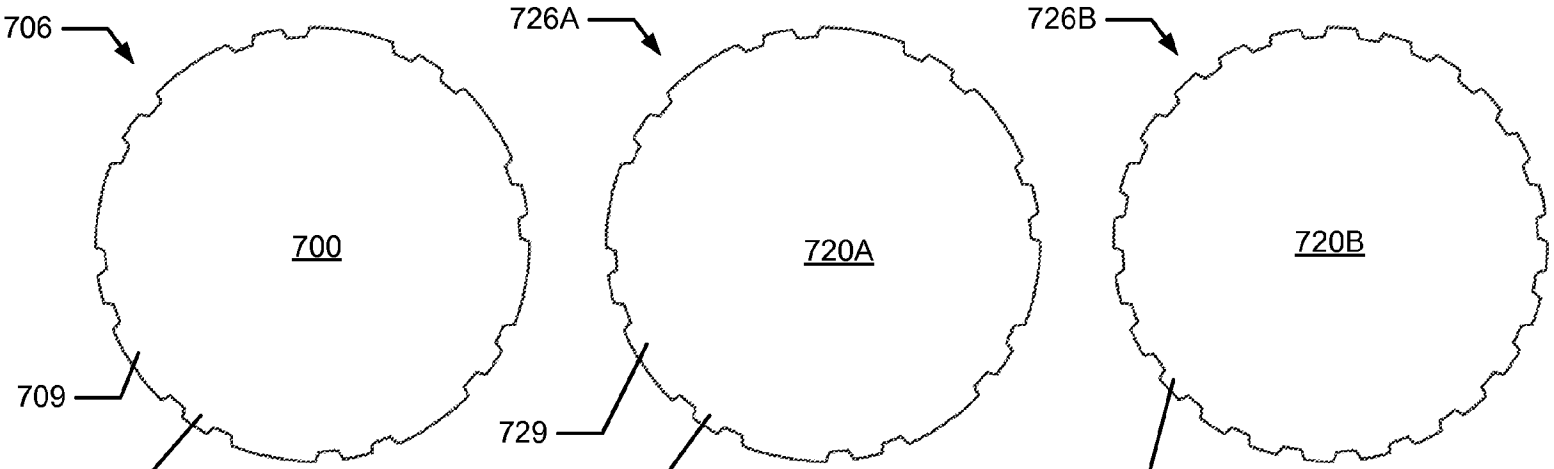
Fig. 7A
Fig. 7B
Fig. 7C
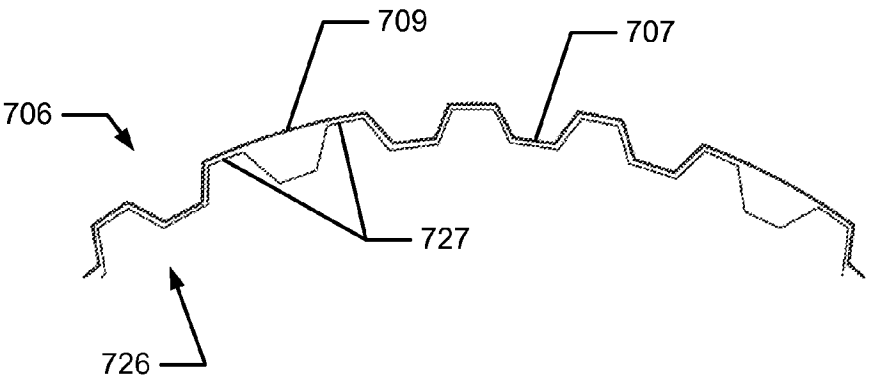
Fig. 7D

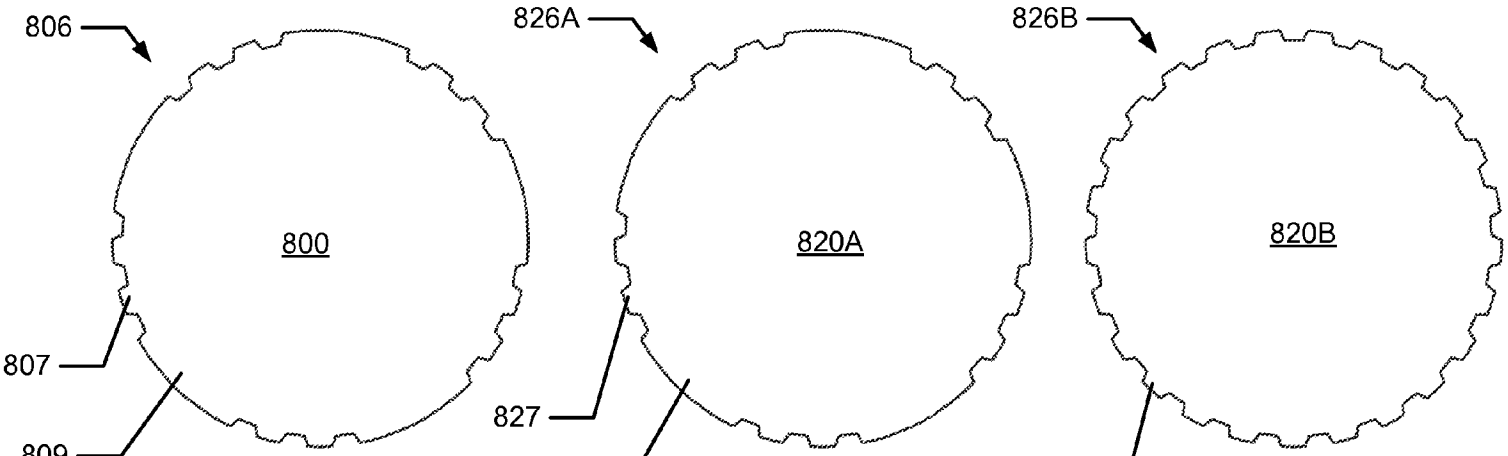
Fig. 8C
Fig. 8B
Fig. 8A
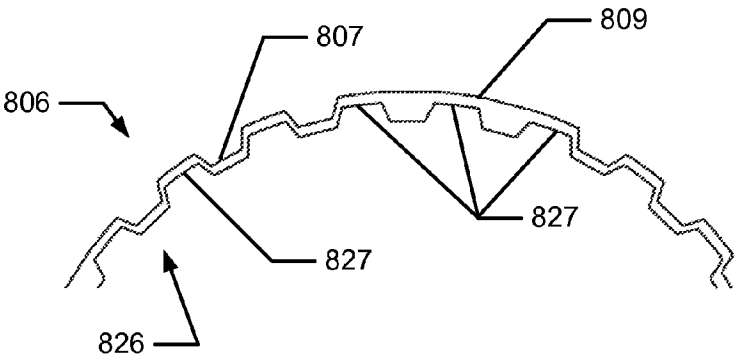
Fig. 8D

RELEASABLE AND INTERCHANGEABLE CONNECTIONS FOR GOLF CLUB HEADS AND SHAFTS

RELATED APPLICATION

This application claims priority to Non-Provisional Application, U.S. Ser. No. 12/509,231, filed Jul. 24, 2009, which is incorporated herein by reference in its entirety.

FIELD OF THE INVENTION

This invention relates generally to golf clubs and golf club heads. More particularly, aspects of this invention relate to golf clubs having releasable connections between the golf club head and the shaft and head/shaft position adjusting features to allow easy interchange of shafts and heads and to allow easy modification of the head/shaft positioning properties.

BACKGROUND

Golf clubs have been the subject of much technological research and advancement in recent years. For example, the market has seen dramatic changes and improvements in putter designs, golf club head designs, shafts, and grips in recent years. Additionally, other technological advancements have been made in an effort to better match the various elements and/or characteristics of the golf club and characteristics of a golf ball to a particular user's swing features or characteristics (e.g., club fitting technology, ball launch angle measurement technology, ball spin rates, etc.).

Given the recent advances in golf, there is a vast array of golf club component parts available to the golfer. For example, club heads are produced by a wide variety of manufacturers in a variety of different models. Moreover, the individual club head models may include multiple variations, such as variations in the loft angle, lie angle, offset features, weighting characteristics, etc. (e.g., draw biased club heads, fade biased club heads, neutrally weighted club heads, etc.). Additionally, the club heads may be combined with a variety of different shafts, e.g., from different manufacturers; having different stiffnesses, flex points, kick points, or other flexion characteristics, etc.; made from different materials; having different masses or dimensions; etc.). Between the available variations in shafts and club heads, there are literally hundreds of different club head/shaft combinations available to the golfer.

Club fitters and golf professionals can assist in fitting golfers with a golf club head/shaft combination that suit their swing characteristics and needs. Conventionally, however, golf club heads are permanently mounted to shafts using cements or adhesives. Therefore, to enable a golfer to test a variety of head/shaft combinations, the club fitter or professional must carry a wide selection of permanently mounted golf club head/shaft combinations (which takes up a considerable amount of storage space and inventory costs) or the club fitter or professional must build new clubs for the customer as the fitting process continues (which takes a substantial amount of time and inventory costs). The disadvantages associated with these conventional options serve to limit the choices available to the golfer during a fitting session and/or significantly increase the expense and length of a session. Moreover, a permanently bonded club head and shaft connection limits the golfer's options as play conditions change from round to round and/or as his/her swing changes over time.

SUMMARY

The following presents a general summary of aspects of the invention in order to provide a basic understanding of the invention and various features of it. This summary is not intended to limit the scope of the invention in any way, but it simply provides a general overview and context for the more detailed description that follows.

Aspects of this invention relate to systems and methods for connecting golf club heads to shafts in a releasable manner so that the club heads and shafts can be readily interchanged and/or so that the angle and/or position of the shaft with respect to the club head body (and its ball striking face) can be readily changed. Golf clubs in accordance with examples of this invention may include: (a) a shaft; (b) a shaft engaging member engaged with the shaft that includes a rotation-inhibiting structure with a circular cross section and a first set of circumferentially spaced teeth; (c) a club head engaging member releasably engaged with the shaft engaging member, wherein the club head engaging member includes a retaining structure with a circular opening and a second set of circumferentially spaced teeth that engages the first set of teeth on the rotation-inhibiting structure to prevent rotation of the club head engaging member with respect to the shaft engaging member; (d) a golf club head engaged with the club head engaging member; and (e) a securing system for releasably securing the club head engaging member with respect to the shaft engaging member. The first set of circumferentially spaced teeth may include a different number of teeth from the second set of circumferentially spaced teeth. The retaining structure may be configured to engage multiple different rotation inhibiting structures. In one example golf club in accordance with this invention, the retaining structure may be configured to engage both an 8-position rotation-inhibiting structure and a 32-position rotation-inhibiting structure. In another example golf club in accordance with this invention, the retaining structure may be configured to engage both an 8-position rotation-inhibiting structure and a 24-position rotation-inhibiting structure. In another example golf club in accordance with this invention, the retaining structure may be configured to engage both a 6-position rotation-inhibiting structure and a 24-position rotation-inhibiting structure. In another example golf club in accordance with this invention, the retaining structure may be configured to engage both a 5-position rotation-inhibiting structure and a 25-position rotation-inhibiting structure.

The club head and shaft may be interchanged with respect to one another by releasing the securing system and interchanging the originally present parts (e.g., shafts, club heads, etc.) with different parts having different characteristics. Additionally or alternatively, the shaft may be angled and/or the chamber for receiving the shaft in the shaft engaging member may be angled with respect to the axial direction of the club head hosel or club head engaging member so as to allow adjustment of the angle or position of the shaft with respect to the club head (e.g., with respect to its ball striking face) by rotating the shaft engaging member with respect to the club head body.

BRIEF DESCRIPTION OF THE DRAWINGS

A more complete understanding of the present invention and certain advantages thereof may be acquired by referring to the following detailed description in consideration with the accompanying drawings, in which:

FIGS. 6A through 8D illustrate example combinations of shaft engaging members and club head engaging members in accordance with this invention;

Figure 1:
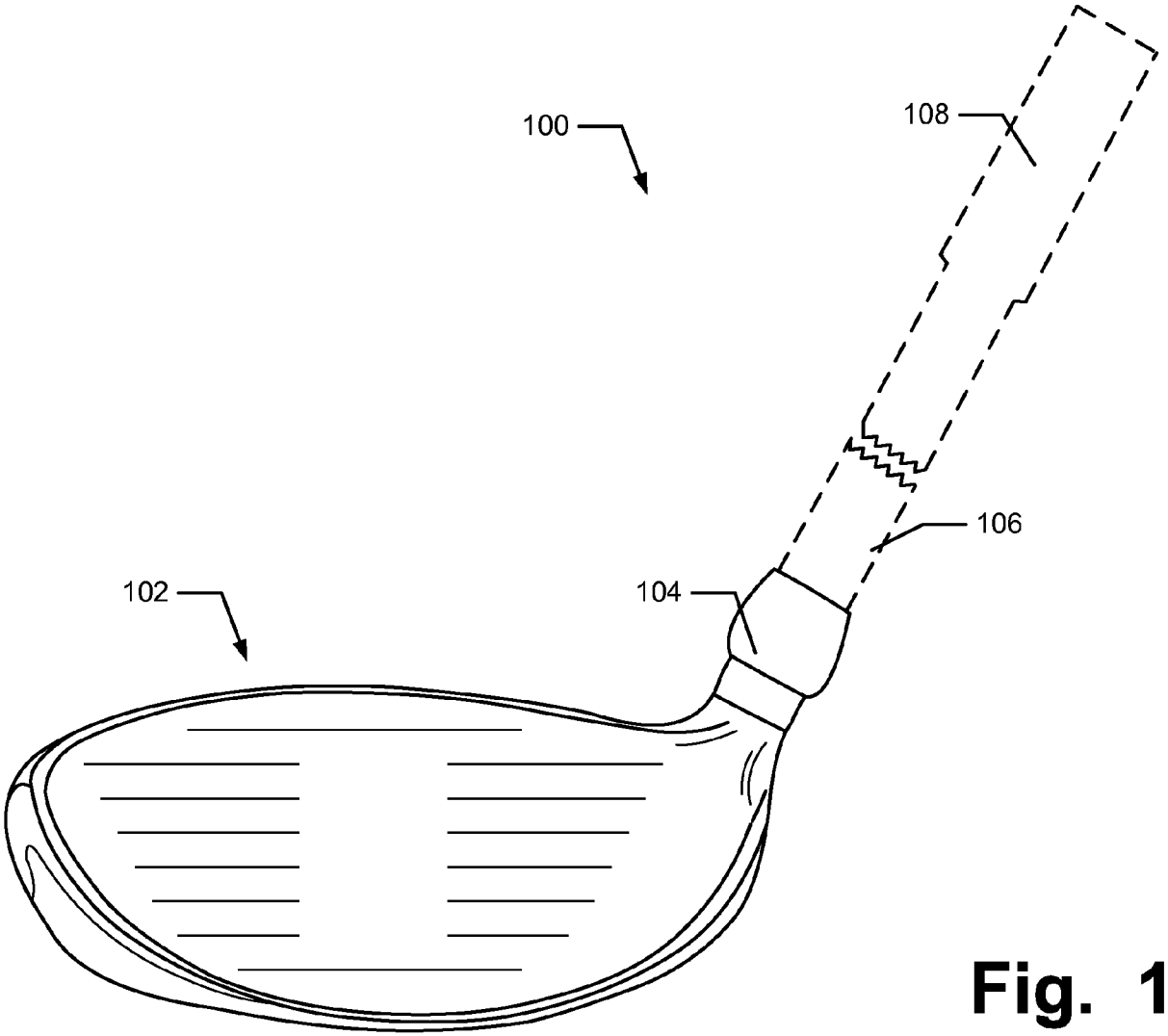
FIG. 1 generally illustrates a front view of an example golf club according to this invention.

The reader is advised that the attached drawings are not necessarily drawn to scale.

DETAILED DESCRIPTION

In the following description of various example structures in accordance with the invention, reference is made to the accompanying drawings, which form a part hereof, and in which are shown by way of illustration various example connection assemblies, golf club heads, and golf club structures in accordance with the invention. Additionally, it is to be understood that other specific arrangements of parts and structures may be utilized, and structural and functional modifications may be made without departing from the scope of the present invention. Also, while the terms "top," "bottom," "front," "back," "rear," "side," "underside," "overhead," and the like may be used in this specification to describe various example features and elements of the invention, these terms are used herein as a matter of convenience, e.g., based on the example orientations shown in the figures and/or the orientations in typical use. Nothing in this specification should be construed as requiring a specific three dimensional or spatial orientation of structures in order to fall within the scope of this invention.

A. General Description of Golf Club Head/Shaft Connection Assemblies and Golf Clubs Including Such Assemblies According to Examples of the Invention In general, as described above, aspects of this invention relate to systems and methods for connecting golf club heads to shafts in a releasable manner so that the club heads and shafts can be readily interchanged and/or repositioned with respect to one another. More detailed descriptions of aspects of this invention follow.

1. Example Golf Club Head/Shaft Connection Assemblies and Golf Club Structures According to the Invention One aspect of this invention relates to golf club head/shaft connection assemblies for securely but releasably connecting a golf club head and shaft. Such assemblies may include, for example: (a) a shaft engaging member including an opening providing access to a cylindrical interior chamber for receiving a golf club shaft and a rotation-inhibiting structure that optionally extends in an axial direction away from the opening and away from the cylindrical interior chamber; (b) a club head engaging member including an opening providing access to an interior chamber for releasably receiving (and holding) at least a portion of the shaft engaging member, wherein the interior chamber of the club head engaging member includes a retaining structure for engaging the rotation-inhibiting structure of the shaft engaging member; and (c) a securing system for releasably securing the shaft engaging member with respect to the club head engaging member. While a variety of different securing structures and securing systems may be used without departing from this invention, in some example structures according to this invention, the securing system may include a securing member extending over an extending portion of the shaft engaging member and releasably engaging a securing structure of the club head engaging member, wherein the securing member, at least in part, releasably secures the shaft engaging member with the club head engaging member. Additionally, the securing system may include a threaded region defined on an exterior surface of the club head engaging member, and the securing system will further include a threaded bolt element that engages the threaded region. Additionally, the securing structure may include a bottom-up connection that includes a threaded hole defined in a second end of the shaft engaging member, and the securing system will include a threaded bolt element that engages the threaded hole. The interior chamber of the club head engaging member and the threaded region on its exterior surface may be coaxial or non-coaxial, and optionally, the interior chamber of the club head engaging member and the threaded region may be completely independent from one another. The assemblies further may include a retaining element engaged with at least one of the shaft engaging member and the club head engaging member.

The rotation-inhibiting structure(s) of the shaft engaging member may take on a wide variety of forms in golf club head/shaft connection assemblies in accordance with examples of this invention. In some example structures, the rotation-inhibiting structure will have a generally circular cross section with a first set of circumferentially spaced teeth. The rotation-inhibiting structure will engage a retaining structure that is provided with a second set of circumferentially spaced teeth. The teeth from the rotation-inhibiting structure will engage with the teeth from the retaining structure to inhibit rotation of the shaft engaging member with respect to the club head engaging member. In some more specific example structures according to the invention, the second set of teeth may have a skip tooth configuration. A single gap in the skip tooth configuration may be sized and arranged to contain two or more teeth from the first set of teeth on the rotation-inhibiting structure. Additionally, the retaining structure may be configured to engage multiple and different rotation-inhibiting structures which may allow one common retaining structure pattern to engage with multiple rotation-inhibiting structures (e.g., rotation-inhibiting structures having different numbers of teeth).

The feature of the skip tooth configuration may allow a single, common club head engaging member to be used with multiple configurations of shaft engaging members. For example, a first line of golf clubs may include a first shaft engaging member that is rotatable among 8 positions, while a second line of golf clubs may include a second shaft engaging member that is rotatable among 32 positions. The common club head engaging member allows the user to custom upgrade from the first line of golf clubs to a 32 position shaft engaging member without modification to the club head. Additionally, within a fitting cart, there may have been a need to have twice as many amount of shafts due to the 8 and 32 position shaft engaging member configurations. With the common club head engaging member, only one set of shafts may be required.

Additionally, The rotation-inhibiting structure of the shaft engaging member also may take on a variety of different sizes and constructions without departing from this invention. In some example structures, the shaft engaging member will be generally cylindrical with an open circular cylindrical chamber for receiving a golf club shaft. The rotation-inhibiting structure may extend beyond this open chamber in the general axial direction of the overall shaft engaging member structure. In some examples, the rotation-inhibiting structure of the shaft engaging member will extend less than 50% of an overall axial length of the shaft engaging member, and it may extend less than 35%, less than 25%, or even less than 15% of the overall axial length of the shaft engaging member. This feature can help keep the overall connection assembly relatively short, compact, and lightweight while also maintaining the proper strength of the connection between the shaft engaging member and the club head engaging member.

2. Example Methods of Assembling Golf Clubs Including Golf Club Head/Shaft Connection Assemblies According to the Invention Another aspect of this invention relates to methods of assembling golf clubs using club head/shaft connection assemblies in accordance with examples of this invention. Such methods may include: (a) engaging a shaft with a shaft engaging member, wherein the shaft engaging member includes an opening providing access to a cylindrical interior chamber and a rotation-inhibiting structure that optionally extends in an axial direction away from the opening and away from the cylindrical interior chamber, and wherein a first end of the shaft extends into the cylindrical interior chamber; (b) engaging a golf club head with a club head engaging member, wherein the club head engaging member includes an opening providing access to an interior chamber; (c) engaging the shaft engaging member with the club head engaging member by placing the shaft engaging member at least partially into the interior chamber of the club head engaging member and engaging the rotation-inhibiting structure of the shaft engaging member with a retaining structure provided in the interior chamber of the club head engaging member (or other rotation-inhibiting structure); and (d) releasably securing the club head engaging member with respect to the shaft engaging member. The various parts of the connection assembly further may have one or more of the various properties and/or constructions described above.

In such structures, the shaft can be quickly and easily exchanged for a different shaft on the club head body (e.g., a shaft of different length, different flex characteristics, different material, different mass, etc.). Such additional club assembly steps may include: (a) releasing the club head engaging member with respect to the shaft engaging member; (b) engaging a second shaft with a second shaft engaging member, wherein the second shaft engaging member includes a second opening providing access to a second cylindrical interior chamber and a second rotation-inhibiting structure, optionally extending in an axial direction away from the second opening and away from the second cylindrical interior chamber, and wherein a first end of the second shaft extends into the second cylindrical interior chamber; (c) engaging the second shaft engaging member with the club head engaging member by placing the second shaft engaging member at least partially into the interior chamber of the club head engaging member and engaging the second rotation-inhibiting structure of the second shaft engaging member with the retaining structure provided in the interior chamber of the club head engaging member (or other rotation-inhibiting structure); and (d) releasably securing the club head engaging member with respect to the second shaft engaging member.

Additionally or alternatively, if desired, in such structures, the club head can be quickly and easily exchanged for a different one on the shaft (e.g., a club head of different loft, lie angle, size, brand, etc.). Such additional club assembly steps may include: (a) releasing the club head engaging member with respect to the shaft engaging member; (b) engaging a second golf club head with a second club head engaging member, wherein the second club head engaging member includes a second opening providing access to a second interior chamber; (c) engaging the shaft engaging member with the second club head engaging member by placing the shaft engaging member at least partially into the second interior chamber of the second club head engaging member and engaging the rotation-inhibiting structure of the shaft engaging member with a second retaining structure provided in the second interior chamber of the second club head engaging member (or other rotation-inhibiting structure); and (d) releasably securing the second club head engaging member with respect to the shaft engaging member.

B. General Description of Position/Angle Adjustable Golf Club Head/Shaft Connection Assemblies and/or Golf Clubs According to Examples of the Invention Additional aspects of this invention relate to systems and methods for connecting golf club heads to shafts in a releasable manner so that the position and/or angle of the club head (e.g., the ball striking face) with respect to the shaft may be adjusted. More detailed descriptions of these aspects of this invention follow.

1. Example Position/Angle Adjustable Golf Club Head/Shaft Connection Assemblies and/or Golf Club Structures According to the Invention Example golf club head/shaft connection assemblies in accordance with this example aspect of the invention may include: (a) a shaft engaging member including an exterior surface and an open first end that define an interior chamber for receiving a golf club shaft, wherein the exterior surface extends in a first axial direction and the interior chamber extends in a second axial direction that differs from the first axial direction; (b) a club head engaging member including an opening providing access to an interior chamber for releasably receiving at least a portion of the shaft engaging member; and (c) a system for preventing rotation of the shaft engaging member with respect to the club head engaging member. With such assemblies, the shaft position and/or angle with respect to the club head (and its ball striking face) may be adjusted by rotating the shaft engaging member with respect to the club head engaging member.

These club head/shaft connection assemblies may have any of the more detailed structures and/or features described above. Moreover, such assemblies may be included as part of golf club structures in the same manner described above.

As another example, golf club structures in accordance with at least some examples of this invention may include shafts having one or more bends or other axial direction changes in them. Such golf club structures may include: (a) a shaft including at least one shaft axial direction change region; (b) a shaft engaging member engaged with the shaft such that the shaft axial direction change region is located external to the shaft engaging member, wherein the shaft engaging member includes a rotation-inhibiting structure; (c) a club head engaging member releasably engaged with the shaft engaging member, wherein the club head engaging member includes a retaining structure engaged with the rotation-inhibiting structure to prevent rotation of the club head engaging member with respect to the shaft engaging member; (d) a golf club head engaged with the club head engaging member; and (e) a securing system for releasably securing the club head engaging member with respect to the shaft engaging member. The club head/shaft connection assemblies may have any of the more detailed structures and/or features described above. Moreover, such assemblies may be included as part of golf club structures, e.g., in the same manners described above.

2. Example Methods of Assembling Golf Clubs Including Golf Club Head/Shaft Connection Assemblies According to this Aspect of the Invention As noted above, golf club head/shaft connection assemblies according to these examples of the invention may be incorporated into an overall club head structure, for example, in the manners generally described above (e.g., engaging a shaft with the shaft engaging member, engaging a club head with the club head engaging member, releasably engaging the engaging members together, and releasably securing the structure together in a non-rotational manner). The position and/or angle of the shaft with respect to the club head (e.g., with respect to the ball striking face) also may be changed. Such methods may include: (a) releasing the shaft engaging member with respect to the club head engaging member; (b) changing a position of the shaft engaging member with respect to the club head engaging member (e.g., by relative rotation) to thereby alter a position of a free end of the shaft with respect to a ball striking face of the club head; and (c) releasably re-securing the shaft engaging member with the club head engaging member to thereby releasably secure the shaft with the golf club head at the changed position. As noted above, the shaft may have one or more bends in it and/or the shaft engaging member may have a non-axial bore for receiving the shaft, to thereby allow for adjustment of the position and/or angle of the shaft with respect to the club head (e.g., its ball striking face).

Specific examples of the invention are described in more detail below. The reader should understand that these specific examples are set forth merely to illustrate examples of the invention, and they should not be construed as limiting the invention.

C. Specific Examples of the Invention

FIG. 1 generally illustrates an example golf club 100 in accordance with at least some examples of this invention. This club 100 includes a club head 102, a releasable club head/shaft connection region 104 that connects the club head to a shaft 106 (which will be described in more detail below), and a grip member 108 engaged with the shaft 106. While a driver/wood-type golf club head 102 is illustrated in FIG. 1, aspects of this invention may be applied to any type of club head, including, for example: fairway wood club heads; iron type golf club heads (of any desired loft, e.g., from a 0-iron or 1-iron to a wedge); wood or iron type hybrid golf club heads; putter heads; and the like. The club heads may be made from conventional materials, in conventional constructions, in conventional manners, as are known and used in the art, optionally modified (if necessary, e.g., in size, shape, etc.) to accommodate the releasable club head/shaft connection parts.

Any desired materials also may be used for the shaft member 106, including conventional materials that are known and used in the art, such as steel, graphite, polymers, composite materials, combinations of these materials, etc. Optionally, if necessary or desired, the shaft may be modified (e.g., in size, shape, etc.) to accommodate the releasable club head/shaft connection parts. The grip member 108 may be engaged with the shaft 106 in any desired manner, including conventional manners that are known and used in the art (e.g., via cements or adhesives, via mechanical connections, etc.). Any desired materials may be used for the grip member 108, including conventional materials that are known and used in the art, such as rubber, polymeric materials, cork, rubber or polymeric materials with cord or other fabric elements embedded therein, cloth or fabric, tape, etc. Optionally, if desired, the grip member 108 (or an overall club head handle member assembly) may be releasably connected to the shaft 106 using a releasable connection like releasable connection 104 (examples of which will be described in more detail below).

Figure 2A:
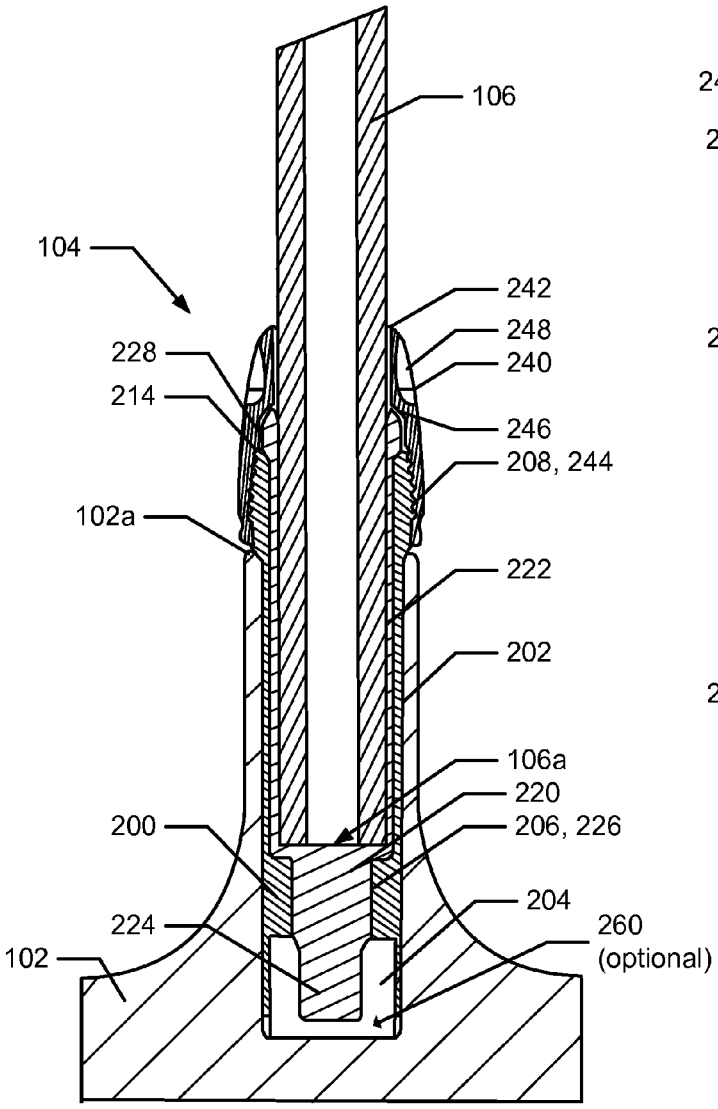
FIGS. 2A and 2B illustrate sectional views of an example golf club head/shaft connection assembly in accordance with this invention in both assembled (FIG. 2A) and exploded (FIG. 2B) conditions.
Figure 2B:
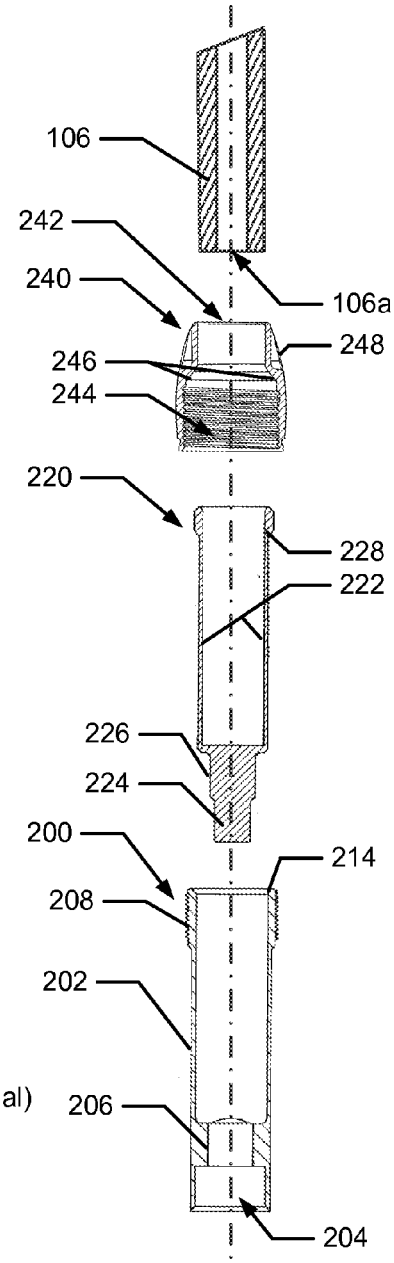

1. Example Releasable and Interchangeable Connections for Golf Club Head/Shaft Connection Assemblies According to the Invention The releasable connection 104 between golf club heads and shafts in accordance with some examples of this invention now will be described in more detail in conjunction with FIGS. 2A through 5C. FIG. 2A provides a detailed sectional view of one example releasable connection 104 between a golf club head 102 and a shaft 106 in accordance with this invention, and FIG. 2B illustrates an exploded view of the parts involved in this example connection 104. As shown in these figures, this example connection 104 includes three main parts, namely: a club head engaging member 200, a shaft engaging member 220, and a securing member 240. The club head engaging member 200 includes a cylindrical outer surface 202 that fits into the opening 102*a* of the club head 102, e.g., at the club head 102's hosel area, and the club head engaging member 200 may be permanently or releasably secured to the club head 102 in any desired manner, e.g., via cements or adhesives; via welding, brazing, soldering, or other fusing techniques; via mechanical connectors; via a friction fit; etc.

The shaft engaging member 220 of this example structure 104 includes a cylindrical interior chamber 222 that may be fit over the free end 106*a* of the shaft 106 and may be secured thereto in any desired manner, e.g., via cements or adhesives; via welding, brazing, soldering, or other fusing techniques; via mechanical connectors; via a friction fit; etc. The securing member 240 fits over the free end 106*a* of the shaft 106 and is located along the shaft 106 above the shaft engaging member 220. The securing member 240 opening 242 is sized so as to be rotatable around the exterior of the shaft 106 for reasons to be described in more detail below.

Once the securing member 240 and the shaft engaging member 220 are engaged with the shaft 106 and the club head engaging member 200 (optionally including the retaining element 260) is engaged with the club head 102, the overall connection 104 then may be assembled. This is accomplished in this example connection structure 104 by sliding the shaft engaging member 220 into the interior chamber of the club head engaging member 200. As the shaft engaging member 220 slides through the club head engaging member 200, the projection portion 224 of the shaft engaging member 220 will extend into the bottom interior chamber portion 204 of the club head engaging member 200. At this configuration, the rotation-inhibiting structures 226 of the shaft engaging member 220 will engage corresponding retaining structure 206 of the club head engaging member 200 to thereby prevent the shaft 106 from rotating with respect to the club head 102. The securing member 240 then slides down the shaft 106, over the upper end of the shaft engaging member 220, and threadingly engages threaded securing structures 208 provided on the club head engaging member 200. Other releasable mechanical connection systems are possible without departing from this invention. Also, the various steps in this example assembly procedure may be changed, combined, changed in order, etc., without departing from this invention.

To release the connection 104, the threaded (or other) securing member 240 is released from the club head engaging member 200, which allows the shaft engaging member 220 to be slid out of the club head engaging member 200 (the shaft engaging member 220 and the securing member 240 remain on the shaft 106 and the club head engaging member 200 remains in the club head 102). In this manner, a different shaft can be quickly and easily engaged with the same club head 102 and/or a different club head can be quickly and easily engaged with the same shaft 106.

Figure 3C:
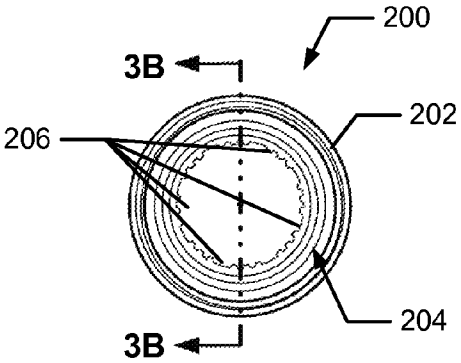
FIGS. 3A through 3D illustrate an example golf club head engaging member that may be used in golf club head/shaft connection assemblies in accordance with this invention.
Figure 3D:
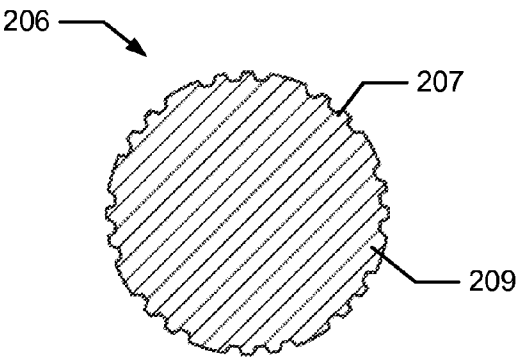
Figure 3A:
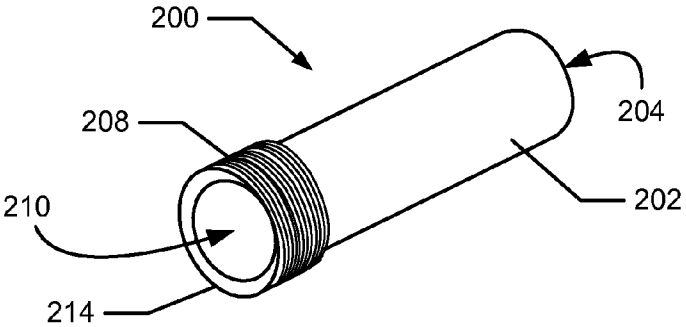
Figure 3B:
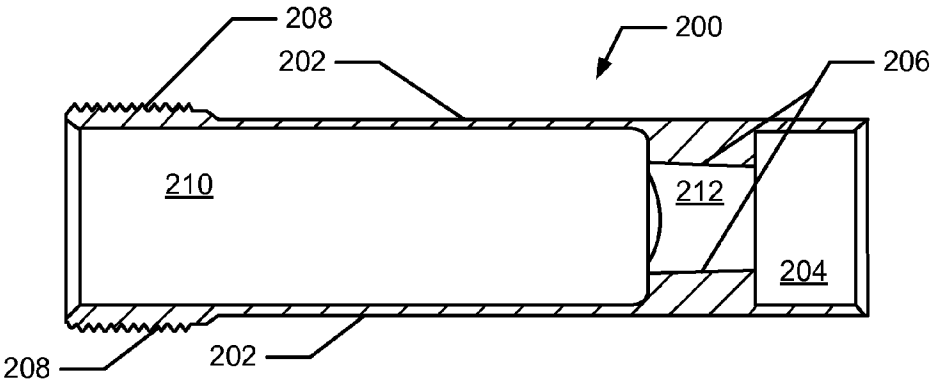

The various individual parts of this example connection structure 104 now will be described in more detail in conjunction with FIGS. 3A through 5C. FIGS. 3A through 3D illustrate the club head engaging member 200 in a perspective view (FIG. 3A), a top view (FIG. 3C), a cross sectional view (FIG. 3B, taken along lines 3B-3B in FIG. 3C), and a close-up of the top view (FIG. 3D) of the retaining structure 206. As illustrated, in this example connection structure 104, the club head engaging member 200 is a cylindrical tube (round) structure with an open threaded end 208 and an opposite open end (adjacent interior chamber 204). The interior of the club head engaging member 200 includes a first tubular section 210 for receiving a portion of the shaft engaging member 220, a circular shaped opening 212 providing the retaining structures 206 that engage the rotation-inhibiting structures 226 of the shaft engaging member 220, and the bottom interior chamber 204 for receiving the projection 224 of the shaft engaging member 220. Additionally, generally, as illustrated in FIGS. 3C and 3D, one of the club head engaging member 200 or the shaft engaging member 220 includes a plurality of gaps 209, 229 between adjacent teeth 207, 227 wherein the gaps 209, 229 are evenly dispersed around the circumference of the club head engaging member 200 or the shaft engaging member 220. The gaps 209, 229 may be sized and arranged to contain multiple teeth 207, 227. Additionally or alternatively, the gaps 209, 229 may be sized and arranged to engage exterior edges of two (or more) different teeth 207, 227. Additionally, the gaps 209, 229 between adjacent teeth 207, 227 may be uniformly distributed around the circumference of the club head engaging member 200 or the shaft engaging member 220. The teeth 207, 227 may be uniformly distributed around the circumference of the club head engaging member 200 or the shaft engaging member 220 and between adjacent gaps 209, 229. Each pair of adjacent gaps 209, 229, as one moves around the circumference of the club head engaging member 200 or the shaft engaging member 220, N teeth 207, 227 are present, wherein N is a whole number of 1 or more.

As illustrated in FIGS. 3C and 3D, the retaining structure 206 may include a plurality of teeth 207 and/or gaps 209 to mate and/or otherwise engage with the rotation-inhibiting structures 226 of the shaft engaging member 220. The retaining structure 206 may be configured to engage multiple different rotation-inhibiting structures as will be explained in more detail below. If desired, the retaining structures 206 may be somewhat sloped (larger or wider toward tubular section 210 as compared to bottom interior chamber 204) to enable easier engagement/disengagement with the rotation-inhibiting structures 226 of the shaft engaging member 220. The outer surface 202 of the club head engaging member 200 may be sized and shaped to fit within and closely engage an opening and/or hosel side walls provided in a golf club head for receiving a shaft (e.g., a hosel opening or other shaft receiving opening provided in a golf club head). The upper free end 214 of the club head engaging member 200 (adjacent the threads 208) is sized and shaped so as to engage a shoulder structure 228 on the shaft engaging member 220 and to help stably position the various parts of the connection structure 104 with respect to one another.

Figure 4B:
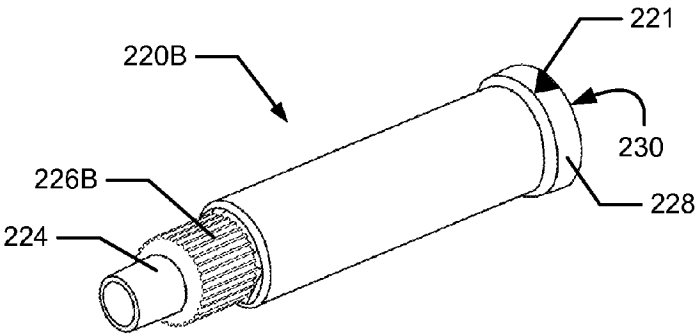
FIGS. 4A through 4F illustrate an example shaft engaging member that may be used in golf club head/shaft connection assemblies in accordance with this invention.
Figure 4D:
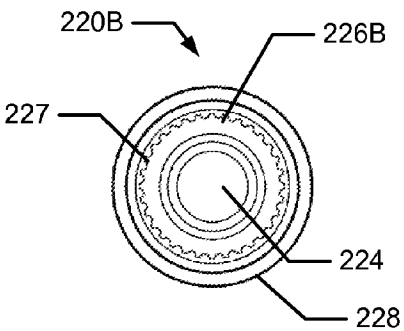
Figure 4A:
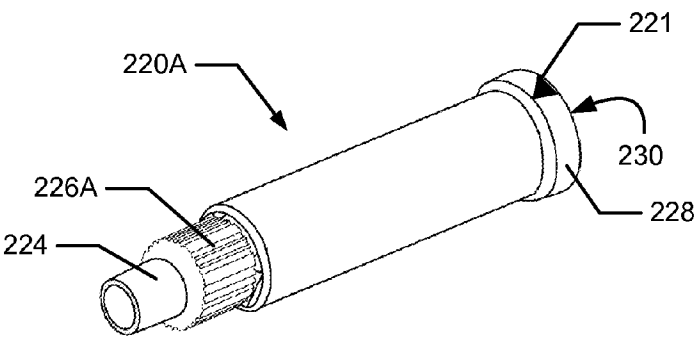
Figure 4C:
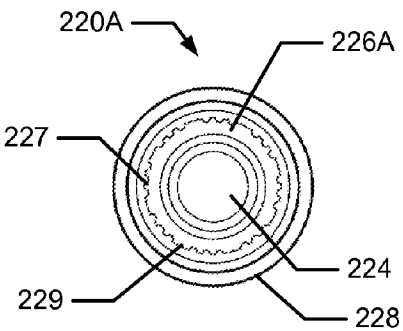
Figure 4E:
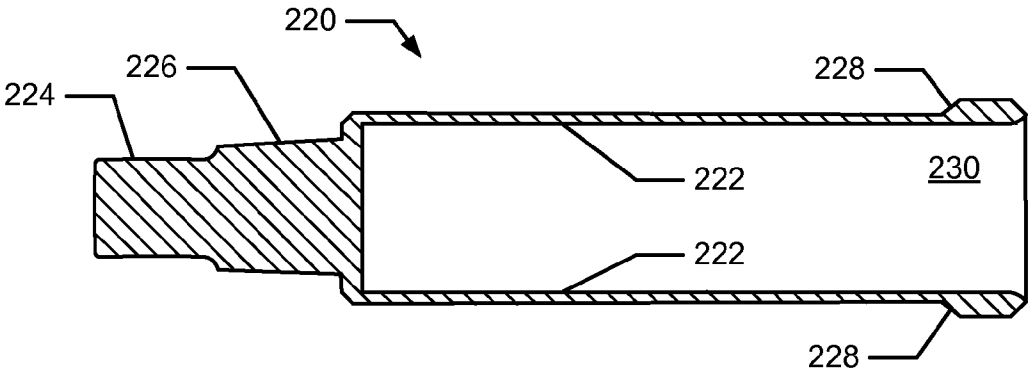
Figure 4G:
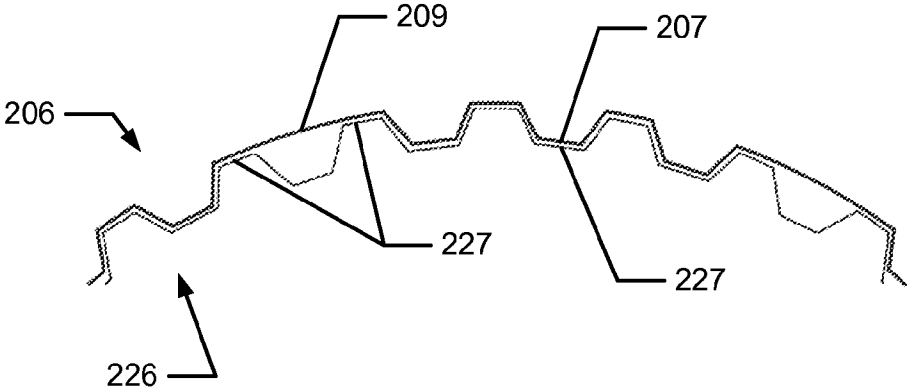
FIG. 4G illustrates a close-up of an example shaft engaging member engaged with the club head engaging member in accordance with this invention.
Figure 4F:
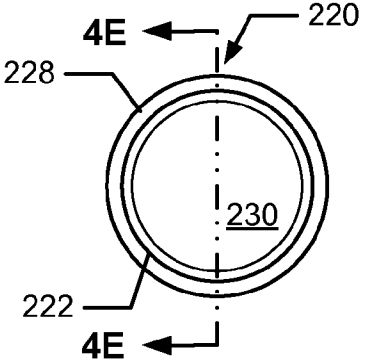

FIGS. 4A through 4F provide more detailed views of various example shaft engaging members 220 of this example connection structure 104. FIGS. 4A and 4B are perspective views of two different example shaft engaging members 220. FIG. 4F is a top view of the shaft engaging member 220 with FIG. 4E being a cross sectional view taken along line 4E-4E in FIG. 4F. FIGS. 4C and 4D are bottom views of the shaft engaging members 220 of FIGS. 4A and 4B respectively. As shown in FIGS. 4A, 4B, 4E, and 4F the shaft engaging member 220 includes an interior chamber 230 for receiving the golf club shaft 106. The rotation-inhibiting member 226 of this example structure 220 extends away from the chamber 230 in the longitudinal or axial direction of the shaft engaging member 220, and the retaining projection 224 extends in the axial direction beyond the rotation-inhibiting member 226. As described above, the rotation-inhibiting member 226 extends into the correspondingly shaped opening 212 provided in the club head engaging member 200 to thereby help prevent rotation of the shaft engaging member 220 with respect to the club head engaging member 200. Like the retaining structure 206, if desired, the rotation-inhibiting member 226 may have somewhat sloped side walls (larger or wider toward chamber 230 as compared to at the retaining projection 224) to enable easier engagement/disengagement with the retaining structures 206 of the club head engaging member 200. FIGS. 4A and 4B show a rotation position indicator 221 on the shaft engaging member 220 (e.g., on the shoulder 228). By noting the relative rotational positions of the shaft engaging member 220 with respect to the club head and/or the club head engaging member, a club fitter or other user can readily determine and know the position of the shaft 106 with respect to the club head body 102 and its ball striking face. If desired, the indicator 221 may be associated with and/or include specific quantitative information, such as a specifically identified loft angle, lie angle, inset distance, offset distance, etc. Additionally, the rotational position indicator 221 may be located on the on the club head 102, the hosel 104, or the club head engaging member 200.

In the example shaft engaging member 220A in FIGS. 4A and 4C, the rotation-inhibiting structure 226A is an 8-position rotation-inhibiting structure 226A that includes a set of circumferentially spaced teeth 227 and a plurality of double-wide teeth 229. The rotation inhibiting structure 226A is configured to engage with the retaining structures 206 on the club head engaging member 200, such that the teeth 227 from the rotation-inhibiting structure 226A engage with the teeth 207 from the retaining structure 206 and the double-wide teeth 229 from the rotation-inhibiting structure 226A engage with the gaps 209 in the retaining structure 206. In the example shaft engaging member 220B in FIGS. 4B and 4D, the rotation-inhibiting structure 226B is a 32-position rotation-inhibiting structure 226B that includes a plurality of circumferentially spaced teeth 227. The rotation-inhibiting structure 226B is configured to mate with the retaining structures 206 on the club head engaging member 200, such that some of the teeth 227 from the rotation-inhibiting structure 226B engage with the teeth 207 from the retaining structure 206 and such that the gaps 209 in the retaining structure 206 can hold two teeth. Optionally, if desired, the gaps 209 can be sized, shaped, and arranged to hold more than two teeth (e.g., from 3-8 teeth).

Figure 5A:
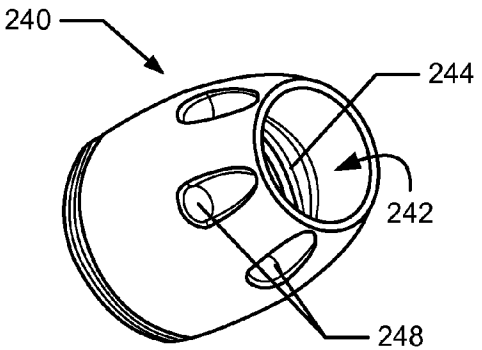
FIGS. 5A through 5C illustrate an example securing member that may be used in golf club head/shaft connection assemblies in accordance with this invention.
Figure 5B:
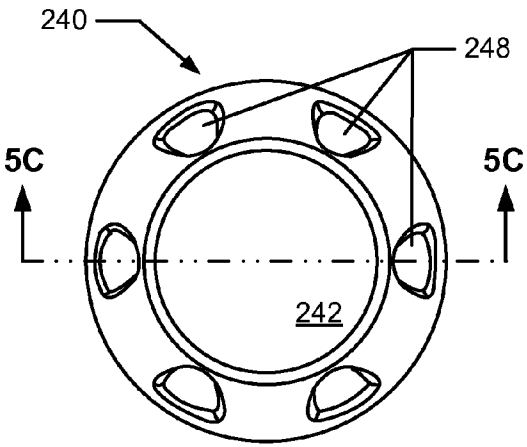
Figure 5C:
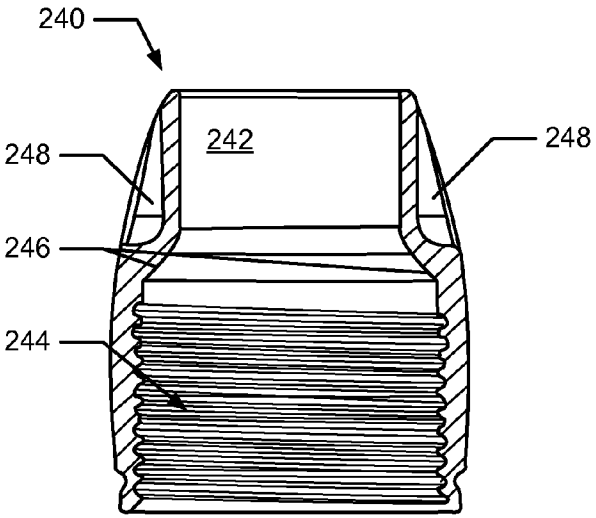

An example club head/shaft securing member 240 in accordance with this invention is illustrated in more detail in FIGS. 5A through 5C (FIG. 5A is a perspective view, FIG. 5B is a top view, and FIG. 5C is a cross sectional view taken along lines 5C-5C in FIG. 5B). The securing member 240 includes an axial opening 242 sized and shaped so as to enable the securing member 240 to freely slide along the free end of the shaft 106. The interior of the securing member 240 includes threads 244 (or other securing structures) for engaging the securing structures 208 provided on the club head engaging member 200. Interior shoulder regions 246 (in this example structure 240 defined by indentations 248) provide structure to engage and hold down the top portion 228 of the shaft engaging member 220 when the securing member 240 engages the club head engaging member 200.

The various parts of the club head/shaft connection system 104 may be made from any desired or suitable materials without departing from this invention. For example, one or more of the various parts 200, 220, and/or 240 may be made from a metal material, including lightweight metals conventionally used in golf club head constructions, such as aluminum, titanium, magnesium, nickel, alloys containing one or more of these materials, steel, stainless steel, and the like, optionally anodized finished materials. Alternatively, if desired, one or more of the various parts 200, 220, and/or 240 may be made from rigid polymeric materials, such as polymeric materials conventionally known and used in the golf club industry. The various parts 200, 220, and 240 may be made from the same or different materials without departing from this invention. In one specific example, each of the various parts 200, 220, and 240 will be made from a 7075 aluminum alloy material having a hard anodized finish. The parts may be made in conventional manners as are known and used in the metal working and/or polymer production arts.

Many variations in the connection system may be made from the specific structures described above without departing from this invention. For example, if desired, the securing member (e.g., like member 240) may be fit onto the club head structure 102 (e.g., around the hosel), and it may engage external threads (or other securing structures) provided on the shaft engaging member 220. Releasable securing systems other than threaded engagements of a securing member 240 with the club head engaging member 200 and/or the shaft engaging member 220 are possible without departing from this invention. For example, the securing member 240 may include structures that extend into or otherwise engage the club head engaging member 200 and/or the shaft engaging member 220 to thereby hold these members in place with respect to one another. As another example, if desired, the securing member 240 may include slots, openings, or grooves that provide access to structures extending from the club head engaging member 200 and/or the shaft engaging member 220 to thereby hold these members in place with respect to one another. As yet another example, if desired, the separate securing member 240 may be omitted, e.g., if the club head engaging member 200 and/or the shaft engaging member 220 directly include adequate structures to hold themselves in place with respect to one another. The securing member 240 also may be integrally formed or connected with another part of the connection structure 104, the club head 102, and/or the shaft 106.

In addition, if desired, in accordance with at least some examples of this invention, the hosel 104 of the club head 102 may be manufactured so as to include the necessary structures, such as the retaining structures 206 as shown by reference number 206. In this configuration, there is no need to engage a separate club head engaging member 200 with the club head 102, and therefore there may be no need for the club head engaging member 200. Also, if desired, in accordance with at least some examples of this invention, the shaft engaging member 220 can be omitted if the free end of the shaft 106 is constructed with the rotation-inhibiting structures 226A, 226B as described below.

2. Additional Aspects of the Rotation-Inhibiting Structures and Retaining Structures for Golf Club Head/Shaft Connection Assemblies According to the Invention Additional aspects of this invention relate to the rotation-inhibiting structures 226 on the shaft engaging member 220 and the retaining structures 206 on the club head engaging member 200. As can be seen in FIGS. 4A-4D, the rotation-inhibiting structures 226A, 226B on the shaft engaging member 220A, 220B may have a generally circular cross section with a first set of circumferentially spaced teeth 227 that extend radially from the shaft engaging member 220A, 220B. The teeth 227 may be rectangular or square shaped while extending from the shaft engaging member 220A, 220B (e.g., akin to gear teeth). In other example aspects of this invention, the teeth 227 may be other polygons or shapes, such as a trapezoid, triangle, hemispherical, etc. In the example as shown in FIGS. 4C, 4D, and 4G, the teeth 227 are in the shape of an isosceles trapezoid, having sides that angle inward as the tooth 227 extends radially from the shaft engaging member 220A, 220B. Additionally, if desired, the corners of the polygons or shapes, e.g., the rectangles, trapezoids, or squares, may be rounded to better facilitate the engagement with the retaining structure 206.

Additionally, as shown in FIGS. 3C and 3D, the retaining structure 206 may have a circular opening 212 with a second set of circumferentially spaced teeth 207 extending radially from the opening 212. The second set of teeth 207 on the retaining structure 206 are configured to engage with the first set of teeth 227 on the rotation-inhibiting structures 226A and 226B. In the retaining structure 206, the teeth 207 may have a skip tooth configuration, wherein there may be a number of teeth 207 evenly spaced, with gaps 209 between some of those evenly spaced teeth 207. Each of those gaps 209 may be sized to mate with two, three, or four teeth 227 from the rotation-inhibiting structure 226. In an example club head in accordance with this invention, as shown in FIG. 3D, the retaining structure 206 has two teeth 207 and a first gap 209, two teeth 207, and a second gap 209, etc. On the retaining structure 206 from FIG. 3D, there are a total of 16 teeth 207 and 8 gaps 209 with each of the gaps 209 being the size of two teeth 207. Because of this skip tooth configuration with gaps 209, the retaining structure 206 may be configured to engage multiple different rotation-inhibiting structures 226. In other words, in order to maintain the adjustable flexibility of having multiple configurations while working with one club head 102, the retaining structure 206 pattern may be compatible with multiple patterns of rotation-inhibiting structures 226 as will be explained further below.

In the example as shown in FIG. 3D, the retaining structure 206 has a total of 8 gaps 209 and 16 teeth 207 as described above. This retaining structure in FIG. 3D may engage with either a rotation-inhibiting structure 226A as shown in FIGS. 4A and 4C or a rotation-inhibiting structure 226B as shown in FIGS. 4B and 4D. FIGS. 4A and 4C illustrate an 8-position rotation-inhibiting structure 226A on a first shaft engaging member 220A. The rotation-inhibiting structure 226A from FIGS. 4A and 4C has 16 teeth 227 to mate with 16 teeth 207 from the retaining structure 206, as well as 8 additional double-wide teeth 229 to mate with the 8 gaps 209 from the retaining structure 206. To change the position of the shaft engaging member 220A, the shaft engaging member 220A may be removed from the club head engaging member 200, rotated one gap 209 or double-wide tooth 229 (or more, if desired) and then reinserted into the club head engaging member 200. This shaft engaging member 220A can be engaged with the club head engaging member 200 in a total of 8 different positions.

FIGS. 4B and 4D illustrate a 32-position rotation-inhibiting structure 226B on a second shaft engaging member 220B. The rotation-inhibiting structure 226B has 32 teeth 227 evenly spaced around the outside of the shaft engaging member 220B. Of these 32 teeth 227, 16 teeth 227 will engage with 16 teeth 207 from the retaining structure 206 and the other 16 teeth 227 will be located within the 8 gaps 209 on the retaining structure 206. FIG. 4G illustrates how the remaining teeth 227 from the rotation-inhibiting structure 226B are contained within the gaps 209 on the retaining structure 206. For this example combination, to change the position of the shaft engaging member 220B, the shaft engaging member 220B may be removed from the club head engaging member 200, rotated one singular tooth 227 (or more, if desired) and then reinserted into the club head engaging member 200. This shaft engaging member 220B can be engaged with the club head engaging member 200 in a total of 32 different positions. As can be seen by the combinations of the club head engaging member 200 from FIGS. 3C and 3D and the shaft engaging members 220A, 220B from FIGS. 4A and 4B, the common retaining structure 206 from the club head engaging member 200 is configured to engage with an 8-position rotation-inhibiting structure 226A and a 32-position rotation-inhibiting structure 226B from the shaft engaging members 220A, 220B.

Many other combinations of teeth, gaps, and double-wide teeth (or triple-wide, etc.) may be used in golf club head/shaft connection assemblies in accordance with this invention. FIGS. 6A-6C illustrate an example combination according to this invention similar to that described above in conjunction with FIGS. 2A through 5C (the same or similar reference numbers are used in FIGS. 6A-6C as those used in FIGS. 1 through 5C to denote the same or similar parts). As shown in FIGS. 6A-6C, the common retaining structure 606 from the club head engaging member 600 is configured to engage with a 6-position rotation-inhibiting structure 626A and a 24-position rotation-inhibiting structure 626B from the shaft engaging members 620A, 620B. In this example, as shown in FIG. 6A, the retaining structure 606 may have a total of 12 teeth 607 and 6 gaps 609 with each of the gaps 609 being the size of two teeth 607. FIG. 6B illustrates a 6-position rotation-inhibiting structure 626A on a first shaft engaging member 620A. The rotation-inhibiting structure 626A from FIG. 6B has 12 teeth 627 to engage with 12 teeth 607 from the retaining structure 606, as well as 6 additional double-wide teeth 629 to engage with the 6 gaps 609 from the retaining structure 606. The shaft engaging member 620A may be inserted into the club head engaging member 600. To change the position of the shaft engaging member 620A, the shaft engaging member 620A may be removed from the club head engaging member 600, rotated one gap 609 or double-wide tooth 629 (or more) and then reinserted into the club head engaging member 600. This shaft engaging member 620A can be engaged with the club head engaging member 600 in a total of 6 different positions. FIG. 6C, on the other hand, illustrates a 24-position rotation-inhibiting structure 626B on the shaft engaging member 620B. The rotation-inhibiting structure 626B from FIG. 6C has 24 teeth 627 evenly spaced around the outside of the shaft engaging member 620B. Of these 24 teeth 627, 12 teeth 627 will engage with the 12 teeth 607 from the retaining structure 606 and the other 12 teeth 627 are contained within the 6 gaps 609 on the retaining structure 606. FIG. 6D illustrates how the remaining teeth 627 from the rotation-inhibiting structure 626B are contained within the gaps 609 on the retaining structure 606. For this example combination, to change the position of the shaft engaging member 620B, the shaft engaging member 620B may be removed from the club head engaging member 600, rotated one singular tooth 627 (or more), and then reinserted into the club head engaging member 600. This shaft engaging member 620B can be engaged with the club head engaging member 600 in a total of 24 different positions.

FIGS. 7A-7C illustrate an example combination according to this invention similar to that described above in conjunction with FIGS. 2A through 5C (the same or similar reference numbers are used in FIGS. 7A-7C as those used in FIGS. 1 through 5C to denote the same or similar parts). As shown in FIGS. 7A-7C, the common retaining structure 706 from the club head engaging member 700 is configured to engage with an 8-position rotation-inhibiting structure 726A and a 24-position rotation-inhibiting structure 726B from the shaft engaging members 720A, 720B. In this example, as shown in FIG. 7A, the retaining structure 706 may have a total of 8 teeth 707 and 8 gaps 709 with each of the gaps 709 being the size of two teeth 707. FIG. 7B illustrates an 8-position rotation-inhibiting structure 726A on a first shaft engaging member 720A. The rotation-inhibiting structure 726A from FIG. 7B has 8 teeth 727 to engage with 8 teeth 707 from the retaining structure 706, as well as 8 additional double-wide teeth 729 to engage with the 8 gaps 709 from the retaining structure 706. The shaft engaging member 720A may be inserted into the club head engaging member 700. To change the position of the shaft engaging member 720A, the shaft engaging member 720A may be removed from the club head engaging member 700, rotated one gap 709 or double-wide tooth 729 (or more) and then reinserted into the club head engaging member 700. This shaft engaging member 720A can be engaged with the club head engaging member 700 in a total of 8 different positions. FIG. 7C, on the other hand, illustrates a 24-position rotation-inhibiting structure 726B on a second shaft engaging member 720B. The rotation-inhibiting structure 726B from FIG. 7C has 24 teeth 727 evenly spaced around the outside of the shaft engaging member 720B. Of these 24 teeth 727, 8 teeth 727 will engage with the 8 teeth 707 from the retaining structure 706 and the other 16 teeth 727 are contained within the 8 gaps 709 on the retaining structure 706. FIG. 7D illustrates how the remaining teeth 727 from the rotation-inhibiting structure 726B are contained within the gaps 709 on the retaining structure 706. For this example combination, to change the position of the shaft engaging member 720A, the shaft engaging member 720A may be removed from the club head engaging member 700, rotated one singular tooth 727 (or more) and then reinserted into the club head engaging member 700. This shaft engaging member 720B can be engaged with the club head engaging member 700 in a total of 24 different positions.

FIGS. 8A-8C illustrate an example combination according to this invention similar to that described above in conjunction with FIGS. 2A through 5C (the same or similar reference numbers are used in FIGS. 8A-8C as those used in FIGS. 1 through 5C to denote the same or similar parts). As shown in FIGS. 8A-8C, the common retaining structure 806 from the club head engaging member 800 is configured to engage with a 5-position rotation-inhibiting structure 826A and a 25-position rotation-inhibiting structure 826B from the shaft engaging members 820A, 820B. In this example, as shown in FIG. 8A, the retaining structure 806 may have a total of 10 teeth 807 and 5 gaps 809 with each of the gaps 809 being the size of three teeth 807. FIG. 8B illustrates a 5-position rotation-inhibiting structure 826A on a first shaft engaging member 820A. The rotation-inhibiting structure 826A from FIG. 8B has 10 teeth 827 to engage with 10 teeth 807 from the retaining structure 806, as well as 5 additional triple-wide teeth 829 to engage with the 5 gaps 809 from the retaining structure 806. The shaft engaging member 820A may be inserted into the club head engaging member 800. To change the position of the shaft engaging member 820A, the shaft engaging member 820A may be removed from the club head engaging member 800, rotated one gap 809 or triple-wide tooth 829 (or more) and then reinserted into the club head engaging member 800. This shaft engaging member 820A can be engaged with the club head engaging member 800 in a total of 5 different positions. FIG. 8C, on the other hand, illustrates a 25-position rotation-inhibiting structure 826B on a second shaft engaging member 820B. The rotation-inhibiting structure 826B from FIG. 8C has 25 teeth 827 evenly spaced around the outside of the shaft engaging member 820B. Of these 25 teeth 827, 10 teeth 827 will engage with 10 teeth 807 from the retaining structure 806 and the other 15 teeth 827 are contained within the 5 gaps 809 on the retaining structure 806. FIG. 8D illustrates how the remaining teeth 827 from the rotation-inhibiting structure 826B are contained within the gaps 809 on the retaining structure 820B. For this example combination, to change the position of the shaft engaging member 820B, the shaft engaging member 820B may be removed from the club head engaging member 800, rotated one singular tooth 827 (or more) and then reinserted into the club head engaging member 800. This shaft engaging member 820B can be engaged with the club head engaging member 800 in a total of 25 different positions.

A variety of different combinations of number of teeth, number of gaps, number of double/triple-wide teeth, and gap size (e.g., 2, 3, or 4 teeth wide) may be provided without departing from this invention. Additionally, the location of the gaps and double/triple-wide teeth may be reversed as described above without departing from this invention. For example, the gaps may be located on the shaft engaging member and the rotation inhibiting structures, while the double/triple-wide teeth may be located on the club head engaging member and retaining structures without departing from this invention.

In other example structures in accordance with this invention, the club head engaging member 200 may be integral to or otherwise permanently affixed to a club head 102, such as being received within or integrally formed as part of hosel area 104. In such structures, there may be no exterior surface of the club head engaging member 200 (although the hosel bore may extend in an "off-axis" manner from the hosel exterior surface, if an exterior hosel is present in the club head structure).

Figure 9A:
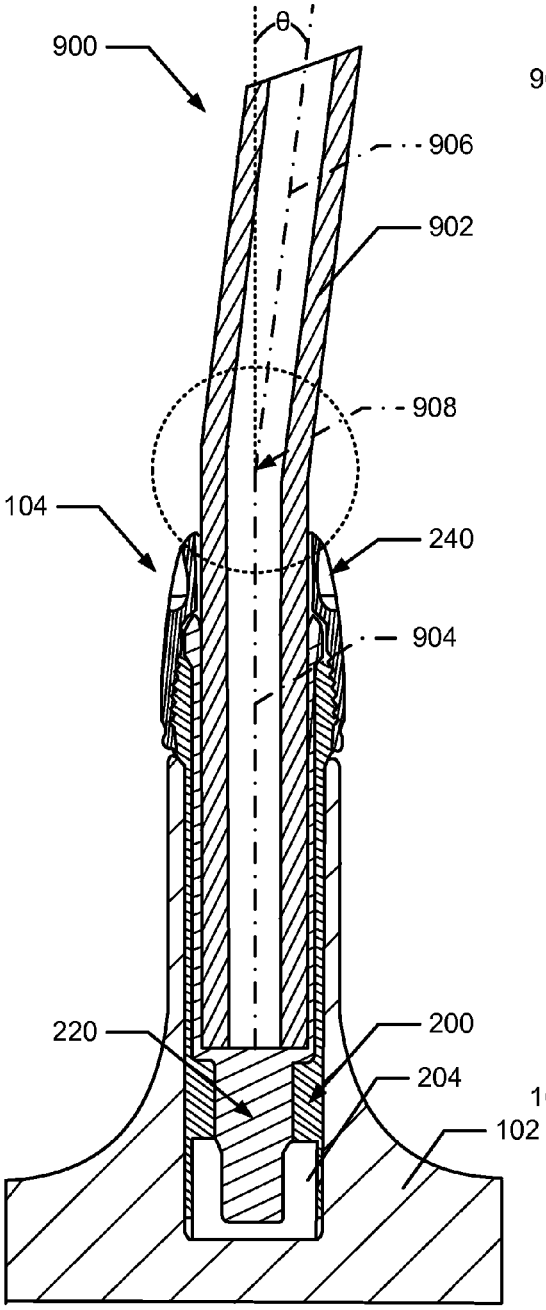
FIGS. 9A and 9B illustrate example aspects of this invention relating to use of an angled shaft member in releasable golf club head/shaft connection assemblies in accordance with this invention.
Figure 9B:
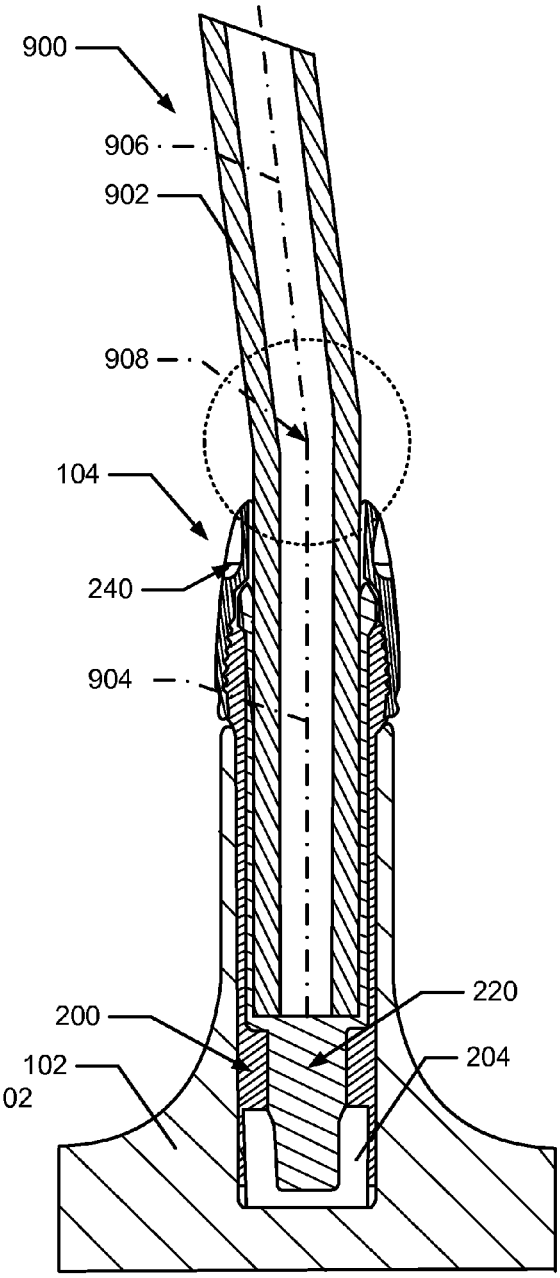

3. Additional Aspects for Position/Angle Adjustable Golf Club Head/Shaft Connection Assemblies and/or Golf Club Structures According to the Invention Additional aspects of this invention relate to utilizing releasable golf club head/shaft connection assemblies to enable club fitters (or others) to adjust various positions and/or angles of the club head (and its ball striking face) with respect to the free (grip) end of the shaft (e.g., lie angle, loft angle, etc.). FIGS. 9A and 9B illustrate one example golf club head/shaft connection system 900 in which these angles can be controlled and adjusted. More specifically, FIGS. 9A and 9B illustrate a releasable golf club head/shaft connection assembly 104 similar to that described above in conjunction with FIGS. 2A through 5C (the same or similar reference numbers are used in FIGS. 9A and 9B as those used in FIGS. 1 through 5C to denote the same or similar parts). The shaft 902, however, in this example structure 900, is bent so as to include a first axial direction 904 extending coaxial with the hosel element extending from the golf club head 102 and a second axial direction 906 extending along a major portion of the shaft 902. The axial direction change region 908 (optionally an abrupt bend or a continuous and/or smooth change) transitions the shaft axial direction from the first direction 904 to the second direction 906.

As evident from a comparison of FIGS. 9A and 9B, the angle and/or position of the free end of the shaft 902 (at the location of the grip, remote from the connection assembly 104) may be altered with respect to the club head 102 (and with respect to the ball striking face) by rotating the shaft engaging member 220 with respect to the club head engaging member 200. This feature, along with the releasable connection system 104, allows club fitters (or others) to freely and easily adjust various angles and/or positions of the shaft 902 with respect to the club head 102 (e.g., variable lie, loft, and face angle combinations) while still using the same shaft 902 and head 102, which can help users more easily determine the optimum club head/shaft combination and arrangement to suit their needs.

The axial direction change region 908 may be located at any desired position along the shaft 902 without departing from this invention. In at least some example structures 900 according to this invention, the axial direction change region 908 will be located in the lower half of the shaft 902 nearer to the club head 102 than to the grip end. In some more specific examples, the axial direction change region 908 will be located in the lower quarter of the shaft 902 nearest to the club head 102, and even in the lower 10% or 5% of the shaft 902 nearest to the club head 102. In some example structures 900 according to the invention, the bend or other axial direction change region 908 may be located as close to the securing member 240 or other portion of the connection assembly as possible while still leaving a sufficient distance from the end of the shaft 902 so as to allow free movement of the securing member 240 or other securing mechanism. Alternatively, if desired, the securing member 240 or other securing mechanism may be sized and arranged so as to slip over the axial direction change region 908, and/or it may be releasable from, removable from, and/or attachable to the shaft 902 or other portion of the assembly 104 in another manner.

Also, any desired axial direction change θ (or bend) angle may be used without departing from this invention, e.g., at least 0.25 degrees, at least 0.5 degrees, at least 1 degree, at least 2 degrees, at least 4 degrees, or even at least 8 degrees. In some example structures, this bend or other axial direction change will be between 0.25 and 25 degrees, between 0.5 and 15 degrees, between 1 and 10 degrees, or even between 1 and 5 degrees.

Aspects of this invention are not limited to golf club shafts having a single axial direction change region. Rather, as illustrated by the structure 1000 shown in FIG. 10A, the shaft 1002 may have multiple axial direction change regions (e.g., regions 1004 and 1006 in FIG. 10A (in FIG. 10A, the same or similar reference numbers are used as those used in FIGS. 1 through 9B to denote the same or similar parts)). This feature allows further fine tuning or control of the position and/or angle of the free end of the shaft 1002 (at the grip) with respect to the club head 102 and its ball striking face (e.g., to adjust positions to provide a range of inset, outset, onset, and offset positions and/or optionally to adjust lie, loft, and/or face angle features).

Figure 10A:
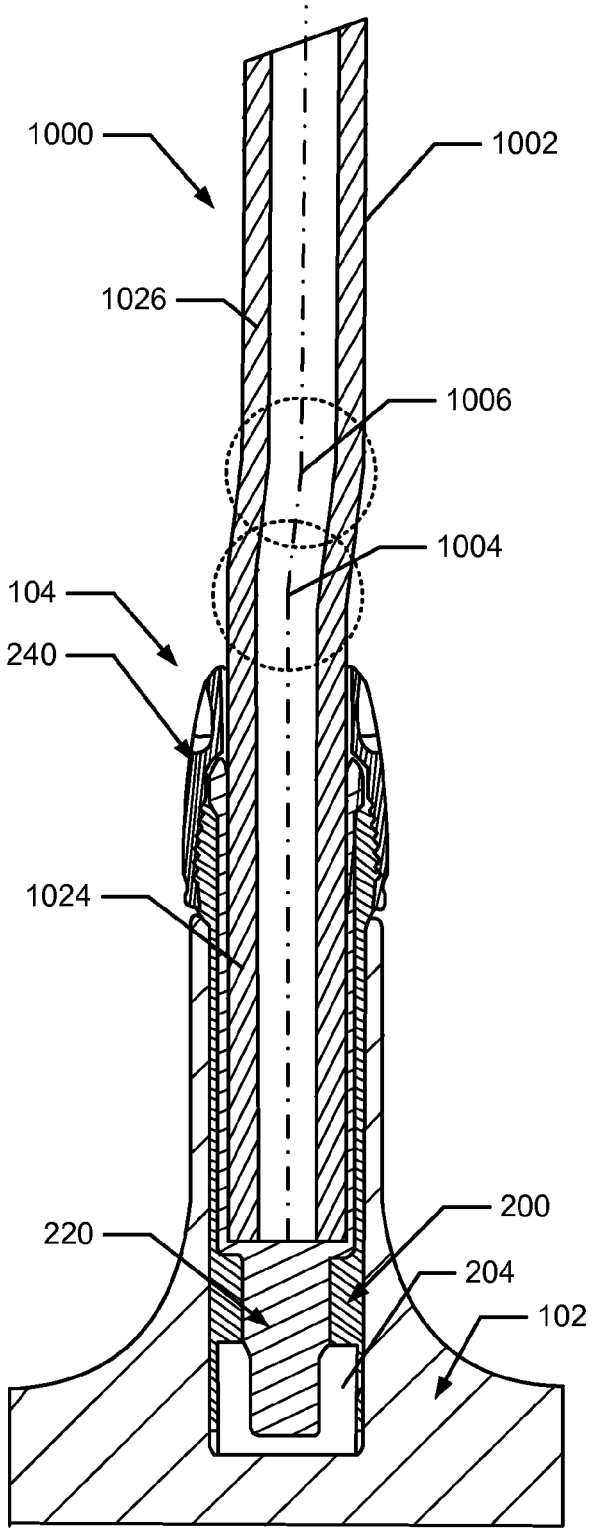
FIGS. 10A and 10B illustrate additional example aspects of this invention relating to use of an angled shaft member in releasable golf club head/shaft connection assemblies in accordance with this invention.
Figure 10B:
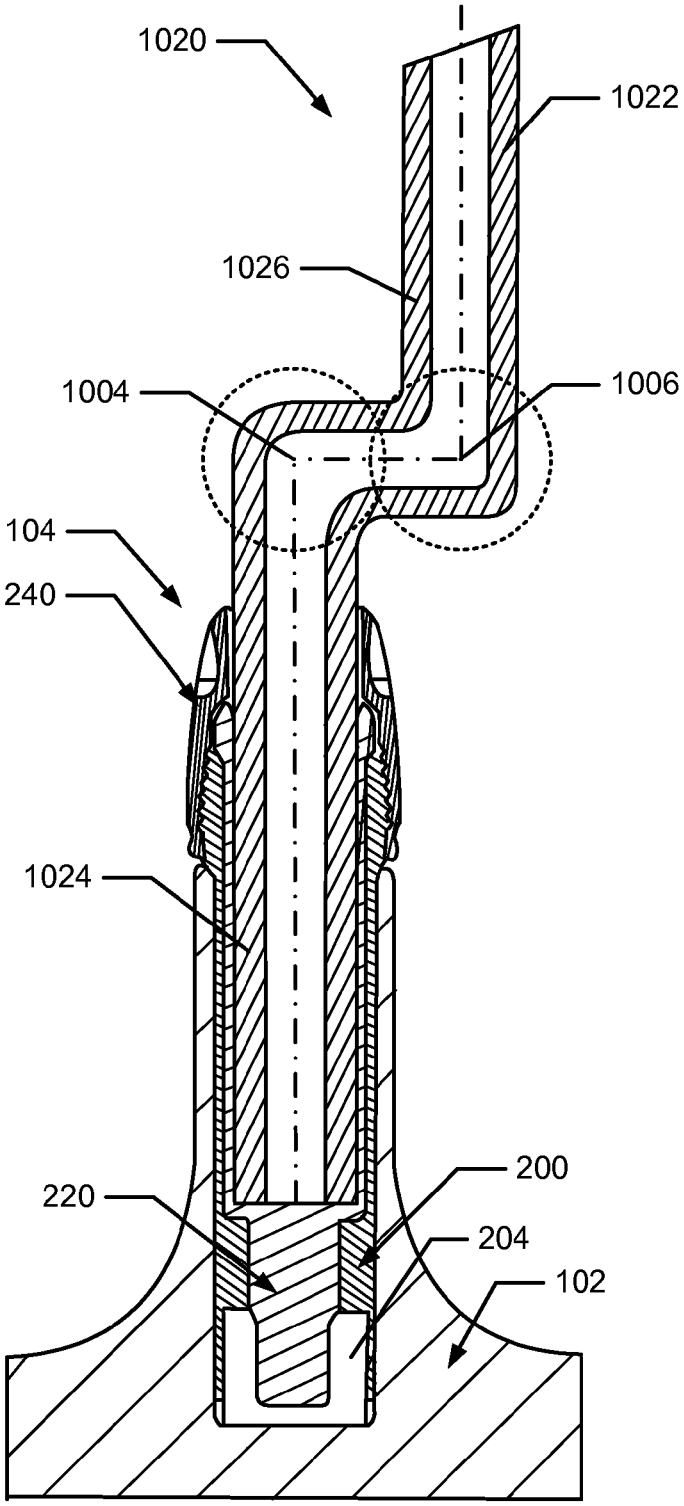

FIG. 10B illustrates another example structure 1020 including a releasable golf club head/shaft connection assembly (e.g., like assembly 104) and a shaft 1022 having two (or more) axial direction change regions 1004 and 1006 like those illustrated in FIG. 10A. In this example structure 1020, however, the shaft 1022 has more abrupt direction changes as compared to the structure 1000 and shaft 1002 of FIG. 10A. This shaft structure 1022 also allows control of the position and/or angle of the free end of the shaft 1022 (at the grip) with respect to the club head 102 and its ball striking face (e.g., to adjust positions to provide a range of inset, outset, onset, and offset positions and/or optionally to adjust lie, loft, and/or face angle features).

The axial direction change regions 1004 and 1006 in the various structures (e.g., structures 1000 and 1020) may be located at any desired positions along the shafts 1002 and/or 1022 and/or at any desired relative spacing with respect to one another without departing from this invention. In at least some example structures 1000 and/or 1020 according to this invention, at least one of the axial direction change regions 1004 and 1006 (and optionally both) will be located in the lower half of the shaft 1002 and/or 1022 nearer to the club head 102 than to the grip end. In some more specific examples, one or both of the axial direction change regions 1004 and 1006 will be located in the lower quarter of the shaft 1002 and/or 1022 nearest to the club head 102, and even in the lower 10% or 5% of the shaft 1002 and/or 1022 nearest to the club head 102. The axial direction change regions 1004 and 1006 may be separated from one another by at least ½ inch, at least 1 inch, at least 2 inches, or even at least 4 inches or more without departing from this invention. The bends or other axial direction change regions 1004 and 1006 may be located a sufficient distance from the end of the shaft 1002 and/or 1022 and/or from one another so as to allow free movement of the securing member 240 or other securing mechanism, if necessary. Alternatively, if desired, the securing member 240 or other securing mechanism may be sized and arranged so as to slip over one or both of the axial direction change regions 1004 and/or 1006, and/or it may be releasable from, removable from, and/or attachable to the shaft 1002 and/or 1022 or other portion of the assembly 104 in another manner.

Also, any desired axial direction change (or bend) angles may be used for each of the two (or more) direction changes without departing from this invention, e.g., at least 0.25 degrees, at least 0.5 degrees, at least 1 degree, at least 2 degrees, at least 4 degrees, or even at least 8 degrees. In some example structures, like those shown in FIG. 10A, these bends or other axial direction changes will be between 0.25 and 25 degrees, between 0.5 and 15 degrees, between 1 and 10 degrees, or even between 1 and 5 degrees. In other example structures, like those shown in FIG. 10B, these bends or other axial direction changes will be between 25 and 145 degrees, between 30 and 120 degrees, between 45 and 100 degrees, or even between 60 and 90 degrees. If desired, one bend may be relatively slight (e.g., as shown in FIG. 10A) while another is more abrupt (e.g., as shown in FIG. 10B). The bends or axial direction changes 1002 and 1004 may be arranged so that the free ends of the shaft (and the shaft sections 1024 and 1026 including the free ends) lie on the same plane or on different planes. Also, if desired, more than two bends or axial direction change regions may be provided in a club head shaft structure without departing from this invention.

Figure 11A:
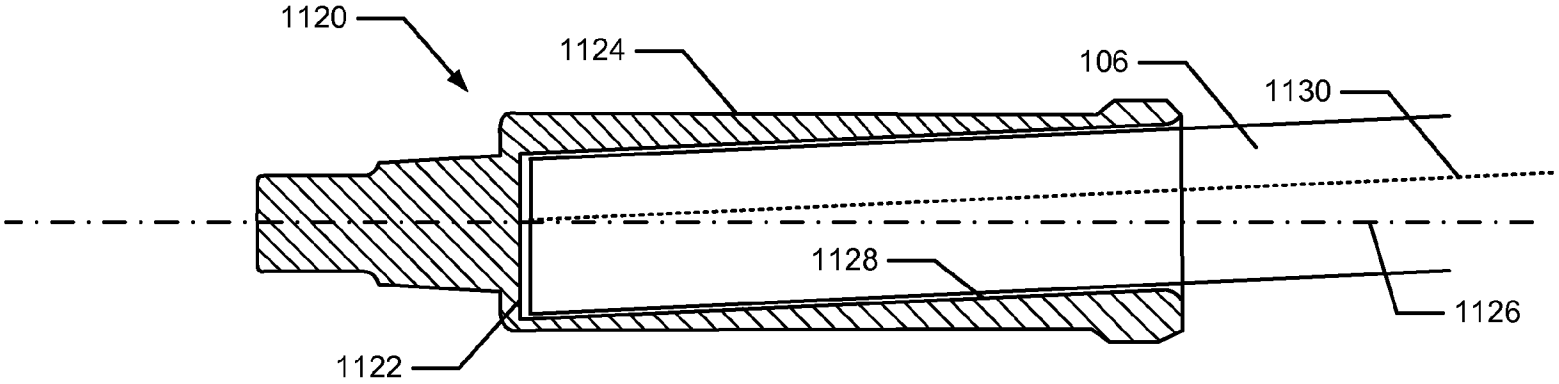
FIGS. 11A and 11B illustrate example aspects of this invention relating to use of an off-axis or angled member for selectively positioning a free end of a shaft with respect to a golf club head face in releasable golf club head/shaft connection assemblies in accordance with this invention.
Figure 11B:
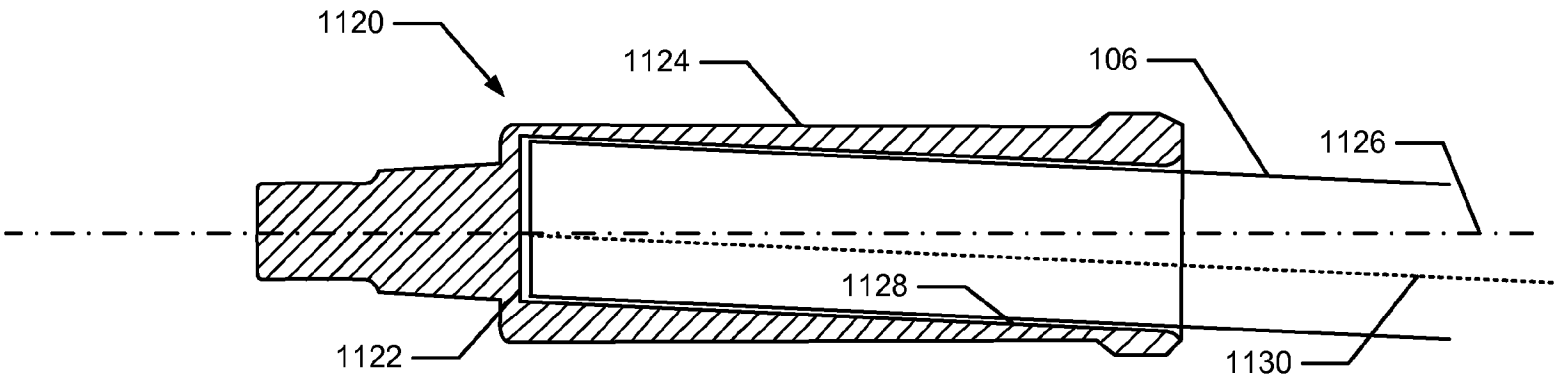

Utilizing a shaft including one or more axial direction change regions is not the only manner in which the position and/or angle of the free (grip) end of a shaft may be altered with respect to a golf club head and/or its ball striking face. FIGS. 11A and 11B illustrate another example arrangement. In this example arrangement, the shaft engaging member 1120 includes an "off-axis" or angled bore hole 1122 in which the shaft 106 is received. More specifically, in this illustrated example, the outer cylindrical surface 1124 of the shaft engaging member 1120 (which matches the direction of an interior chamber of a club head engaging member) extends in a first axial direction 1126, and the interior cylindrical surface 1128 of the bore hole 1122 extends in a second axial direction 1130 that differs from the first axial direction 1126. In this manner, while the shaft engaging member 1120 exterior maintains a constant axial direction corresponding to that of the interior of the club head engaging member (e.g., member 200), the shaft 106 extends away from the club head 102 at a different and adjustable angle with respect to the club head 102 and its ball striking face (the shaft position and/or angle may be adjusted, for example, by rotating the shaft engaging member 1120 with respect to the club head engaging member 200). This may be seen, for example, by a comparison of the angles of FIGS. 11A and 11B.

While any desired angle may be maintained between the first axial direction 1126 and the second axial direction 1130, in accordance with some examples of this invention, this angle will be between 0.25 degrees and 10 degrees, and in some examples between 0.5 degrees and 8 degrees, between 0.75 degrees and 6 degrees, or even between 1 degree and 4 degrees.

If desired, the shaft engaging member 1120 described above may be used in connection with a shaft connection assembly similar to those described above in conjunction with FIGS. 1-8D. The securing member 240 may have sufficient space or play (and/or the angle of the angled bore 1122 may be sufficiently small) so as to enable the securing member 240 to slide over the angle between the shaft 106 and the shaft engaging member 1120 exterior surface 1124. Alternatively, different securing arrangements may be used to engage the shaft engaging member 1120 with the club head and/or the club head engaging member without departing from this invention, including, for example, any of the various securing arrangements and variations thereon described above.

Figure 12A:
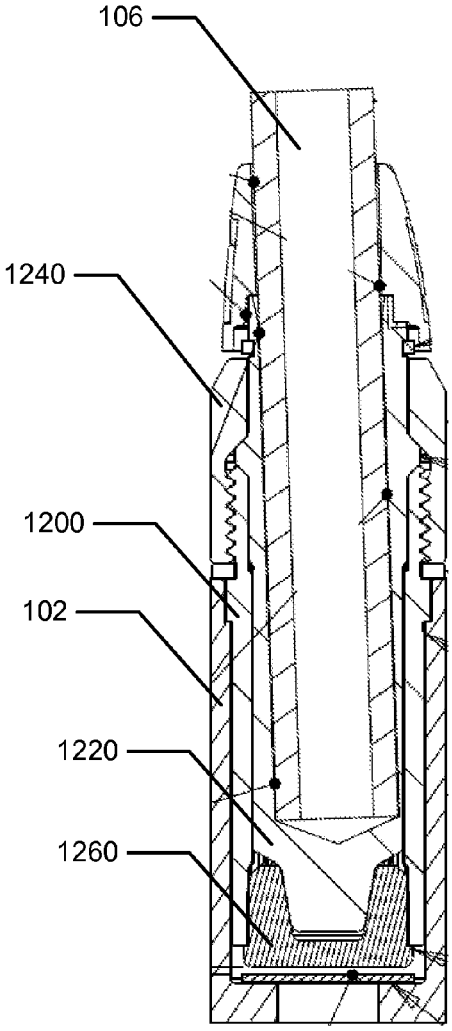
FIG. 12A illustrates a sectional view of an example golf club head/shaft connection assembly in accordance with this invention.
Figure 12B:
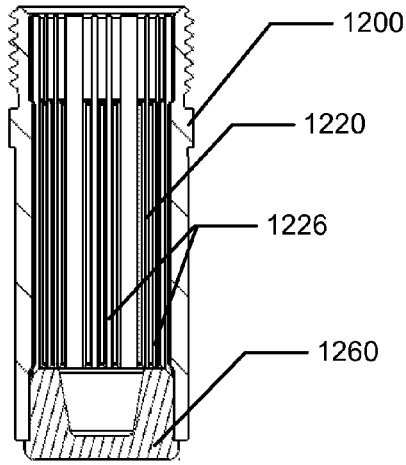
FIG. 12B illustrates a section view of an exploded view of the golf club head engaging member and shaft engaging member from FIG. 12A.
Figure 12C:
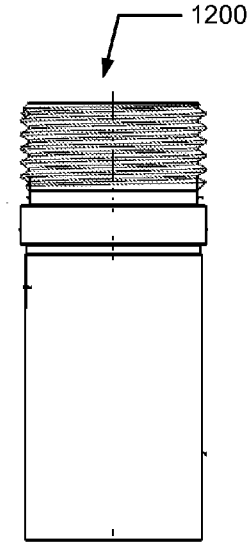
FIGS. 12C and 12D illustrate an example golf club head engaging member that may be used in golf club head/shaft connection assemblies in accordance with this invention.
Figure 12E:
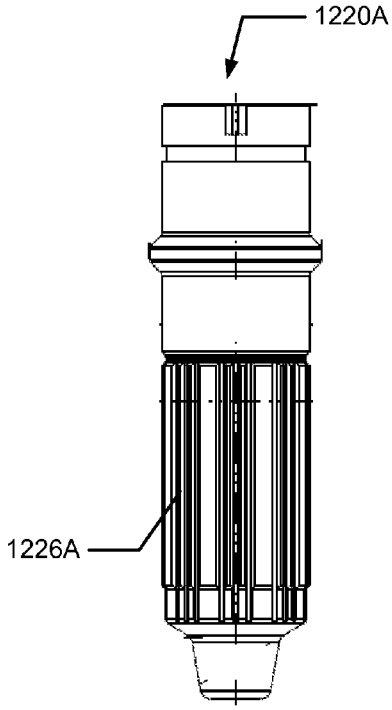
FIGS. 12E through 12H illustrate an example shaft engaging member that may be used in golf club head/shaft connection assemblies in accordance with this invention.
Figure 12G:
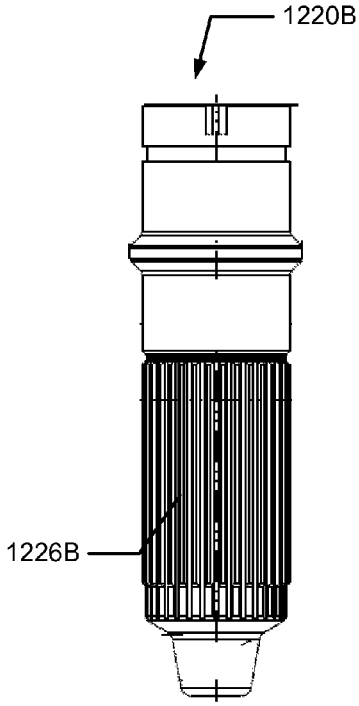
Figure 12D:
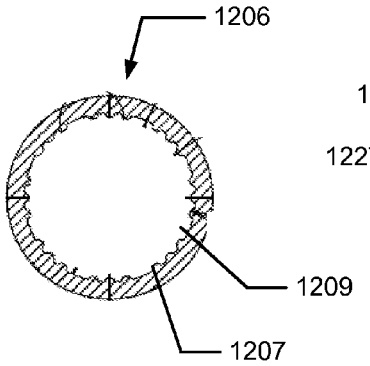
Figure 12F:
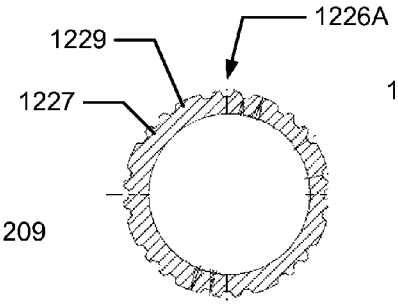
Figure 12H:
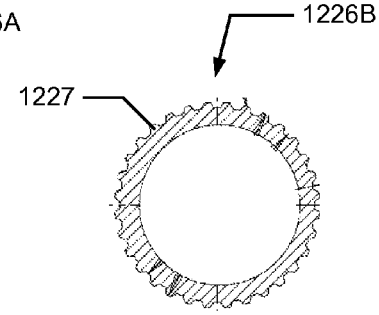
Figure 13:
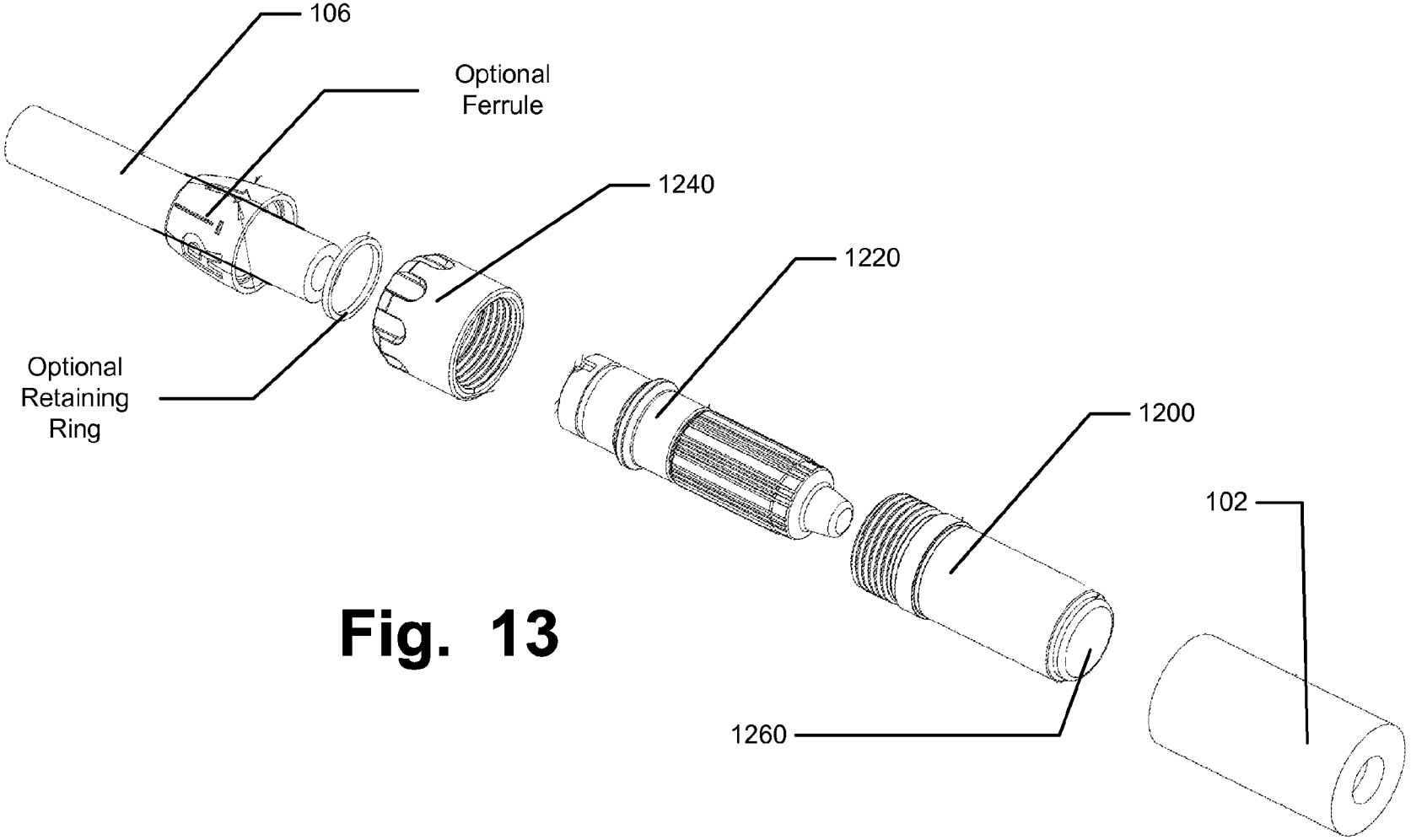
FIG. 13 illustrates an exploded view of the example golf club head/shaft connection assembly from FIG. 12A.

FIGS. 12A-13 illustrate another example releasable connection system in accordance with some examples of this invention similar to that described above in conjunction with FIGS. 2A through 5C (the same or similar reference numbers are used in FIGS. 12A-13 as those used in FIGS. 1 through 5C to denote the same or similar parts). FIG. 12A provides a detailed sectional view of another example releasable connection between a golf club head 102 and a shaft 106 in accordance with this invention, and FIG. 13 illustrates an exploded view of the parts involved in this example connection. As described above for FIGS. 2-5C, and shown in these figures, this example connection includes three main parts, namely: a club head engaging member 1200, a shaft engaging member 1220, and a securing member 1240. The club head engaging member 1200 fits into an opening of the club head 102, e.g., at the club head 102's hosel area, and the club head engaging member 1200 may be permanently or releasably secured to the club head 102 in any desired manner, e.g., via cements or adhesives; via welding, brazing, soldering, or other fusing techniques; via mechanical connectors; via a friction fit; via a threaded or other releasable connector; etc.

The shaft engaging member 1220 of this example releasable connection may fit over the end of the shaft 106 and may be secured thereto in any desired manner, e.g., via cements or adhesives; via welding, brazing, soldering, or other fusing techniques; via mechanical connectors; via a friction fit; etc. The securing member 1240 fits over the end of the shaft 106 and is located along the shaft 106 above the shaft engaging member 1220.

Once the securing member 1240 and the shaft engaging member 1220 are engaged with the shaft 106 and the club head engaging member 1200 (optionally including the retaining element 1260) is engaged with the club head 102, the overall connection then may be assembled. This is accomplished in this example connection structure 104 by sliding the shaft engaging member 1220 into the interior chamber of the club head engaging member 1200. As the shaft engaging member 1220 slides through the club head engaging member 1200, the end of the shaft engaging member 1220 will extend into the bottom of the club head engaging member 1200. At this configuration, the rotation-inhibiting structures 1226 of the shaft engaging member 1220 will engage corresponding retaining structure 1206 of the club head engaging member 1200 to thereby prevent the shaft 106 from rotating with respect to the club head 102. The securing member 1240 then slides down the shaft 106, over the upper end of the shaft engaging member 1220, and threadingly engages the club head engaging member 1200. Other releasable mechanical connection systems are possible without departing from this invention. Also, the various steps in this example assembly procedure may be changed, combined, changed in order, etc., without departing from this invention.

To release the connection, the threaded (or other) securing member 1240 is released from the club head engaging member 1200, which allows the shaft engaging member 1220 to be slid out of the club head engaging member 1200 (the shaft engaging member 1220 and the securing member 1240 remain on the shaft 106 and the club head engaging member 1200 remains in the club head 102 in this example structure). In this manner, a different shaft can be quickly and easily engaged with the same club head 102 and/or a different club head can be quickly and easily engaged with the same shaft 106. Optionally, without departing from the invention, a positioning ferrule and a retaining ring, as illustrated (and not numbered) in FIG. 13, may be included with this connection structure.

As was discussed above for FIGS. 3A through 4G, and as is illustrated in FIGS. 12C through 12H, the club head engaging member 1200 may include the retaining structures 1206 that engage the rotation-inhibiting structures 1226 of the shaft engaging member 1220. Additionally, generally, as illustrated in FIGS. 12D, F, and H, the club head engaging member 1200 and the shaft engaging member 1220 may include a plurality of gaps 1209, 1229 between adjacent teeth 1207, 1227 wherein the gaps 1209, 1229 and teeth 1207, 1227 may be evenly dispersed around the circumference of the club head engaging member 1200 and the shaft engaging member 1220.

As illustrated in FIGS. 12C and 12D, the retaining structure 1206 may include a plurality of teeth 1207 and/or gaps 1209 to mate and/or otherwise engage with the rotation-inhibiting structures 1226 of the shaft engaging member 220. The retaining structure 1206 may be configured to engage multiple different rotation-inhibiting structures as will be explained in more detail below.

FIGS. 12E through 12H provide more detailed views of various example shaft engaging members 1220 of this example connection system. FIGS. 12E and 12G are views of two different example shaft engaging members 1220. As described above, the rotation-inhibiting member 1226 extends into the club head engaging member 1200 to thereby help prevent rotation of the shaft engaging member 1220 with respect to the club head engaging member 1200.

In the example shaft engaging member 1220A in FIGS. 12E and 12F, the rotation-inhibiting structure 1226A is an 8-position rotation-inhibiting structure 1226A that includes a set of circumferentially spaced teeth 1227 and a plurality of double-wide teeth 1229. The rotation inhibiting structure 1226A is configured to engage with the retaining structures 1206 on the club head engaging member 1200, such that the teeth 1227 from the rotation-inhibiting structure 1226A engage with the teeth 1207 from the retaining structure 1206 and the double-wide teeth 1229 from the rotation-inhibiting structure 1226A engage with the gaps 1209 in the retaining structure 1206. In the example shaft engaging member 1220B in FIGS. 12G and 12H, the rotation-inhibiting structure 1226B is a 32-position rotation-inhibiting structure 1226B that includes a plurality of circumferentially spaced teeth 1227. The rotation-inhibiting structure 1226B is configured to mate with the retaining structures 1206 on the club head engaging member 1200, such that some of the teeth 1227 from the rotation-inhibiting structure 1226B engage with the teeth 1207 from the retaining structure 1206 and such that the gaps 1209 in the retaining structure 1206 can hold two teeth. Optionally, if desired, the gaps 1209 can be sized, shaped, and arranged to hold more than two teeth (e.g., from 3-8 teeth).

This releasable connection system as described above and illustrated in FIGS. 12A through 13 may include any of the off-axis, axial direction change regions, or position/lie angle golf club/shaft connection systems as described above and illustrated in FIGS. 9A-11B without departing from the invention. This releasable connection system also may include any desired tooth and/or skip tooth patterns or arrangements, including any of the various patterns or arrangements described above.

Additionally, the releasable connection assemblies may be used in any desired manner without departing from the invention. The clubs with such connection assemblies may be designed for use by the golfer in play (and optionally, if desired, the golfer may freely change shafts, heads, and/or their positioning with respect to one another). As another example, if desired, clubs including releasable connections in accordance with the invention may be used as club fitting tools and when the desired combination of head, shaft, and positioning have been determined for a specific golfer, a club builder may use the determined information to then produce a final desired golf club product using conventional (and permanent) mounting techniques (e.g., cements or adhesives). Other variations in the club/shaft connection assembly parts and processes are possible without departing from this invention.

Club heads and releasable and interchangeable connections for golf club heads and shafts in accordance with at least some examples of this invention also may have some or all of the characteristics described in U.S. Pat. No. 6,890,269 dated May 10, 2005 in the name of Bruce D. Burrows, U.S. Published Patent Appln. No. 2009/0011848, filed on Jul. 6, 2007 in the name of John Thomas Stites, et al., U.S. Published Patent Appln. No. 2009/0011849, filed on Jul. 6, 2007 in the name of John Thomas Stites, et al., U.S. Published Patent Appln. No. 2009/0011850, filed on Jul. 6, 2007 in the name of John Thomas Stites, et al., and U.S. Published Patent Appln. No. 2009/0062029, filed on Aug. 28, 2007 in the name of John Thomas Stites, et al., which documents are entirely incorporated herein by reference.

CONCLUSION

While the invention has been described in detail in terms of specific examples including presently preferred modes of carrying out the invention, those skilled in the art will appreciate that there are numerous variations and permutations of the above described systems and methods. Thus, the spirit and scope of the invention should be construed broadly as set forth in the appended claims.

I claim:

1. A golf club, comprising:

a shaft;

a shaft engaging member engaged with the shaft, wherein the shaft engaging member includes a rotation-inhibiting structure having a circular cross section and a first set of circumferentially spaced teeth around an entire circumference of the shaft engaging member;

a club head engaging member releasably engaged with the shaft engaging member, wherein the club head engaging member includes a second set of circumferentially spaced teeth, the second set of teeth engaging the first set of teeth on the rotation-inhibiting structure to prevent rotation of the club head engaging member with respect to the shaft engaging member, and wherein the first set of circumferentially spaced teeth includes a different number of teeth from the second set of circumferentially spaced teeth around the entire circumference of the shaft engaging member;

a golf club head engaged with the club head engaging member; and a securing system for releasably securing the club head engaging member with respect to the shaft engaging member.

2. A golf club according to claim 1, wherein the second set of teeth of the club head engaging member has a skip tooth configuration, and wherein one gap in the skip tooth configuration is sized to contain at least two teeth from the first set of teeth on the rotation-inhibiting structure.

3. A golf club according to claim 1, wherein the rotation-inhibiting structure is either an 8-position rotation-inhibiting structure or a 32-position rotation-inhibiting structure and the club head engaging member is configured to engage both the 8-position rotation-inhibiting structure and the 32-position rotation-inhibiting structure.

4. A golf club according to claim 1, wherein the rotation-inhibiting structure is either a 5-position rotation-inhibiting structure or a 25-position rotation-inhibiting structure and the club head engaging member is configured to engage both the 5-position rotation-inhibiting structure and the 25-position rotation-inhibiting structure.

5. A golf club according to claim 1, wherein the rotation-inhibiting structure is either a 6-position rotation-inhibiting structure or a 24-position rotation-inhibiting structure and the club head engaging member is configured to engage both the 6-position rotation-inhibiting structure and the 24-position rotation-inhibiting structure.

6. A golf club according to claim 1, wherein an exterior surface of the shaft engaging member includes a rotational position indicator.

7. A golf club according to claim 1, wherein the rotation-inhibiting structure extends less than 35% of an overall axial length of the shaft engaging member.

8. A golf club according to claim 1, wherein the shaft engaging member has a first end that includes an opening that defines a cylindrical interior chamber for receiving the shaft, wherein an exterior surface of the shaft engaging member extends in a first axial direction and the cylindrical interior chamber extends in a second axial direction that differs from the first axial direction.

9. A golf club according to claim 8, wherein the difference in direction between the first axial direction and the second axial direction allows selective changing of an angle of the shaft with respect to a ball striking face of the golf club by rotating the shaft engaging member with respect to the club head engaging member.

10. A golf club according to claim 1, wherein the shaft includes a shaft axial direction change region, wherein the shaft axial direction change region is located external to the shaft engaging member.

11. A golf club according to claim 10, wherein the shaft axial direction change region allows selective changing of an angle of the shaft with respect to a ball striking face of the golf club by rotating the shaft engaging member with respect to the club head engaging member.

12. A golf club, comprising:

a shaft;

a shaft engaging member engaged with the shaft, the shaft engaging member having a first end and a second end, wherein the first end includes an opening providing access to a cylindrical interior chamber for receiving an end of the shaft, wherein an exterior surface of the first end includes an extending portion extending in a radial direction away from the cylindrical interior chamber, and wherein an exterior surface of the second end located beyond the cylindrical interior chamber includes a rotation-inhibiting structure having a circular cross section and a first set of circumferentially spaced teeth around an entire circumference of the shaft engaging member;

a club head engaging member releasably engaged with the shaft engaging member, the club head engaging member having a first end and a second end, wherein the first end of the club head engaging member includes an opening releasably receiving the shaft engaging member, wherein the first end of the club head engaging member further includes a securing structure, wherein an interior of the second end of the club head engaging member includes a second set of circumferentially spaced teeth, the second set of teeth engaging with the first set of teeth on the rotation-inhibiting structure, and wherein the first set of circumferentially spaced teeth includes a different number of teeth from the second set of circumferentially spaced teeth around the entire circumference of the shaft engaging member;

a golf club head engaged with the club head engaging member; and a securing member extending over the extending portion of the shaft engaging member and releasably engaging the securing structure of the club head engaging member, wherein the securing member, at least in part, releasably secures the shaft engaging member with the club head engaging member.

13. A golf club according to claim 12, wherein the exterior surface of the shaft engaging member includes a rotational position indicator.

14. A golf club according to claim 12, wherein an exterior surface of the shaft engaging member extends in a first axial direction and the cylindrical interior chamber extends in a second axial direction that differs from the first axial direction.

15. A golf club according to claim 14, wherein the difference in direction between the first axial direction and the second axial direction allows selective changing of an angle of the shaft with respect to a ball striking face of the golf club by rotating the shaft engaging member with respect to the club head engaging member.

* * * * *